US009579243B2

(12) United States Patent
Rice et al.

(10) Patent No.: US 9,579,243 B2
(45) Date of Patent: Feb. 28, 2017

(54) PATIENT TRANSFER DEVICE

(71) Applicant: ILIFT2ASSIST, LLC, Grayson, KY (US)

(72) Inventors: Benjamin S. Rice, Grayson, KY (US); Trevor Joseph Wunderlich, Hugo, MN (US)

( * ) Notice: Subject to any disclaimer, the term of this patent is extended or adjusted under 35 U.S.C. 154(b) by 0 days.

(21) Appl. No.: 14/915,792

(22) PCT Filed: Oct. 5, 2015

(86) PCT No.: PCT/US2015/053984
§ 371 (c)(1),
(2) Date: Mar. 1, 2016

(87) PCT Pub. No.: WO2016/054633
PCT Pub. Date: Apr. 7, 2016

(65) Prior Publication Data

US 2016/0310338 A1 Oct. 27, 2016

Related U.S. Application Data

(60) Provisional application No. 62/059,483, filed on Oct. 3, 2014.

(51) Int. Cl.
*A61G 7/10* (2006.01)
*A61G 1/003* (2006.01)
*A61G 1/02* (2006.01)

(52) U.S. Cl.
CPC ..... *A61G 7/1019* (2013.01); *A61G 1/003* (2013.01); *A61G 1/0237* (2013.01); *A61G 1/0275* (2013.01); *A61G 7/0518* (2016.11); *A61G 7/0528* (2016.11); *A61G 7/103* (2013.01); *A61G 7/1032* (2013.01); *A61G 7/1034* (2013.01); *A61G 7/1046* (2013.01); *A61G 7/1036* (2013.01); *A61G 2203/16* (2013.01); *A61G 2203/20* (2013.01)

(58) Field of Classification Search
CPC ..... A61G 7/10
See application file for complete search history.

(56) References Cited

U.S. PATENT DOCUMENTS 4,631,761 A * 12/1986 Lederman ..... A61G 7/1019 5/87.1
5,163,189 A * 11/1992 DeGray ..... A61G 7/1015 180/19.2
5,185,894 A * 2/1993 Bastert ..... A61G 7/1019 5/81.1 C (Continued)

*Primary Examiner* — David E Sosnowski
*Assistant Examiner* — Rahib Zaman
(74) *Attorney, Agent, or Firm* — Leyendecker & Lemire LLC

(57) ABSTRACT

A patient transfer device and an associated method of transferring a patient using the device are described. The device, which can be used anytime a patient needs to be moved or transferred out of bed especially in those circumstances wherein the patient is in any way incapacitated and is unable to move or assist in the transfer, transfers the patient laterally from a longitudinal side of the bed onto the device. The transfer can be accomplished with minimal medical staff interaction and as such significantly and substantially reducing the risk or injury and harm not only for the patient but also the staff.

30 Claims, 34 Drawing Sheets

(56) References Cited

U.S. PATENT DOCUMENTS

| | | | | | |
|---|---|---|---|---|---|
| 5,201,377 | A * | 4/1993 | Wilson | A61G 5/045 | 180/6.5 |
| 5,428,851 | A * | 7/1995 | Shore | A61G 7/1019 | 5/424 |
| 5,937,456 | A * | 8/1999 | Norris | A61G 7/1019 | 5/81.1 R |
| 6,065,162 | A * | 5/2000 | Behr | A61G 7/1032 | 248/173 |
| 6,854,137 | B2 * | 2/2005 | Johnson | A61G 7/1019 | 5/81.1 C |
| 6,932,209 | B2 * | 8/2005 | Kasagami | A61G 7/1032 | 198/312 |
| 7,540,044 | B2 * | 6/2009 | Patterson | A61G 7/1019 | 5/81.1 C |
| 7,578,011 | B2 * | 8/2009 | Johnson | A61G 7/1019 | 5/81.1 C |
| 8,214,943 | B2 * | 7/2012 | Patterson | A61G 7/1032 | 280/771 |
| 2010/0138990 | A1 * | 6/2010 | Van Oirschot | A61G 7/1011 | 5/86.1 |
| 2012/0291196 | A1 * | 11/2012 | Konda | A61G 7/1019 | 5/81.1 C |
| 2013/0269710 | A1 * | 10/2013 | Hight | A61G 13/04 | 128/845 |

* cited by examiner

PATIENT TRANSFER DEVICE

RELATED PATENT APPLICATIONS

This application claims priority and incorporates fully by reference U.S. Provisional Patent Application No. 62/059,483 filed on Oct. 3, 2014 entitled Patient Transfer Device. The referenced provisional patent application has at least one common inventor with the present application.

BACKGROUND

Often mobility impaired patients must be transferred to and from hospital beds, examination tables and operating tables. Traditional devices, including wheeled gurneys and stretchers, often require the use of several personnel to affect transfer, which can require pulling personnel from other jobs or functions, if only momentarily, to assist. Transfers using these devices can lead be very evasive to the patient and the staff. These devices can result in additional injury and stress to both the patient and the staff if the transfer process is not meticulously followed by all involved. Even if transfers are affected according to procedure, they still allow and even cause significant body movement of the patient that can result in patient stress, pain, injury, and discomfort. Usually, if the patient is cooperative and not injured or disabled, it is a simple matter for the individual to slide over to the gurney with the assistance of a nurse, but if the patient is unconscious or has a disability or an injury (e.g., a broken bone) that might be worsened by movement, then great care must be taken in transferring the patient from a bed to a gurney. This problem is exacerbated when the patient is above average weight.

One solution to the disabled or unconscious patient transfer problem is to slide a tray or sheet under the patient and then, after the patient is resting atop it, pull the tray or sheet off the bed and onto the gurney. A rigid tray can usually be forcibly slid between the patient and the bed, and a sheet can be incrementally pushed under the person by first rocking him away from the gurney and then rocking back toward the gurney as the sheet is drawn under. This approach can still be difficult if the patient is uncooperative (i.e., unconscious), and can further be very uncomfortable even if the patient is cooperative, due to the frictional engagement of the tray with the body or the lack of firm support by the sheet.

Automated transfer devices have been proposed that reduce the number of workers required for a transfer and make the transfers safer and less traumatic for the patient. However, devices proposed to date have all suffered from one or more drawbacks and have not seen widespread implementation.

DETAILED DESCRIPTION

Overview

Figure 1:
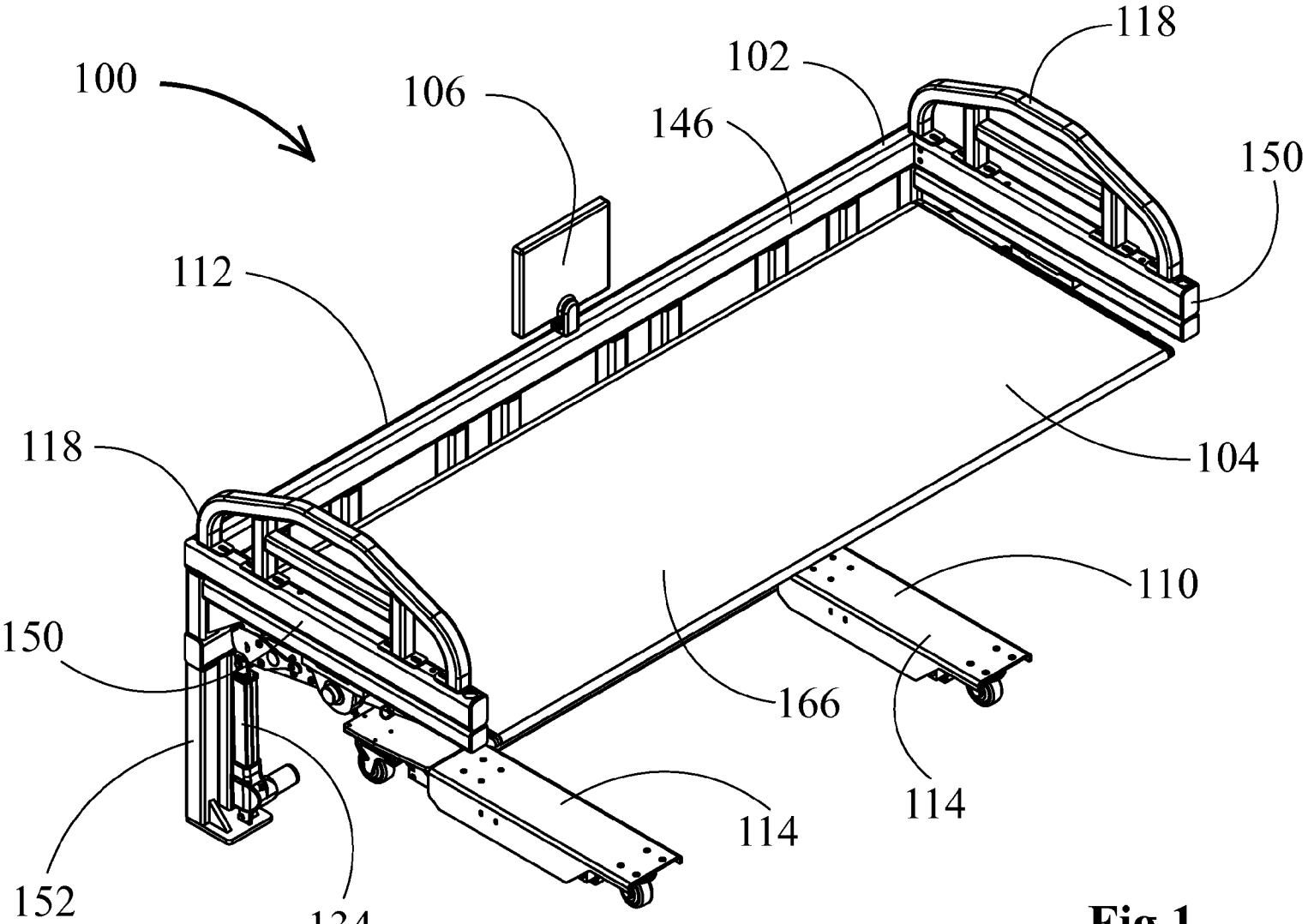
FIG. 1 is a perspective front view of the patient transfer device according to one embodiment of the present invention.
Figure 2:
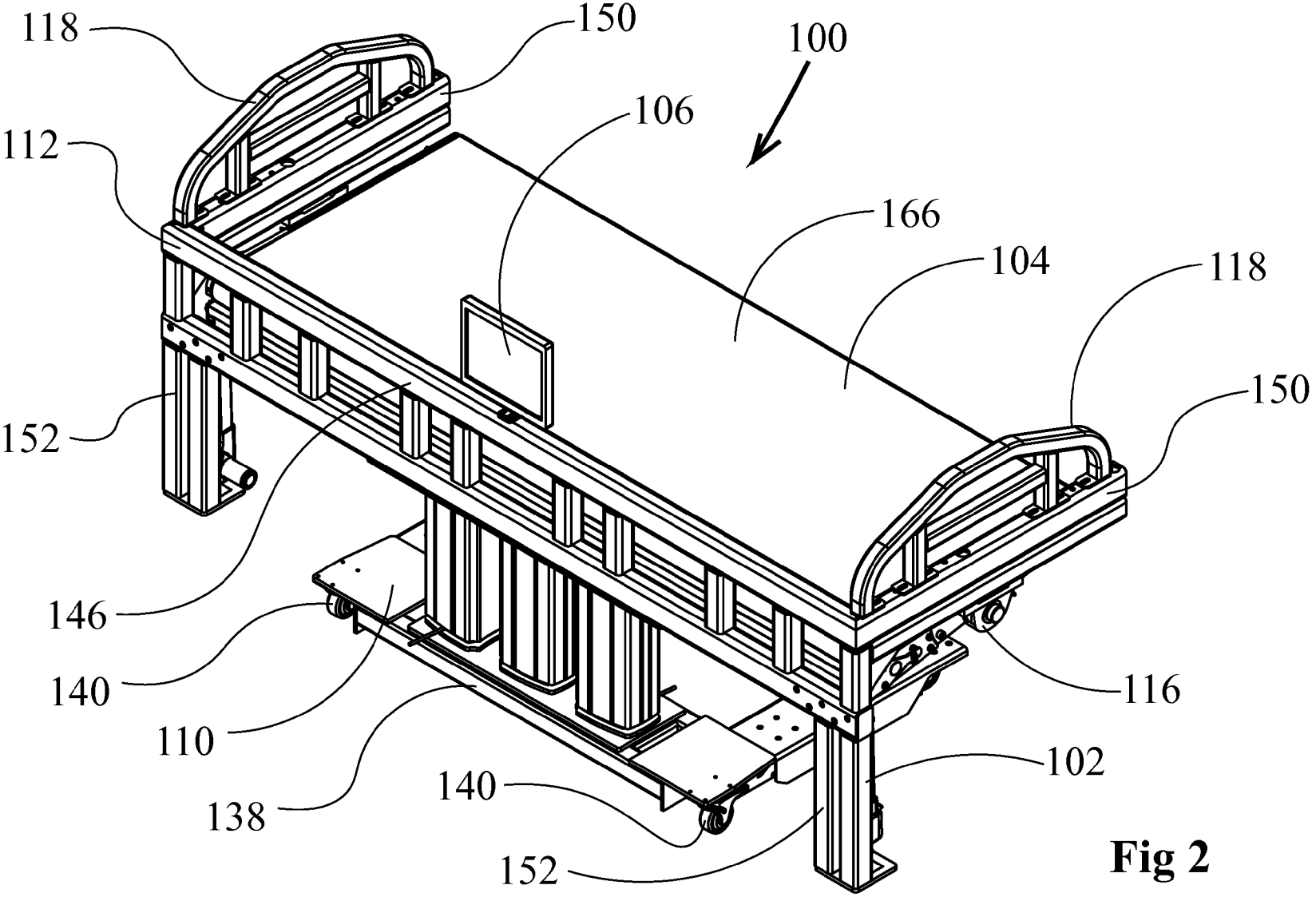
FIG. 2 is a perspective rear view of the patient transfer device according to one embodiment of the present invention.
Figure 3:
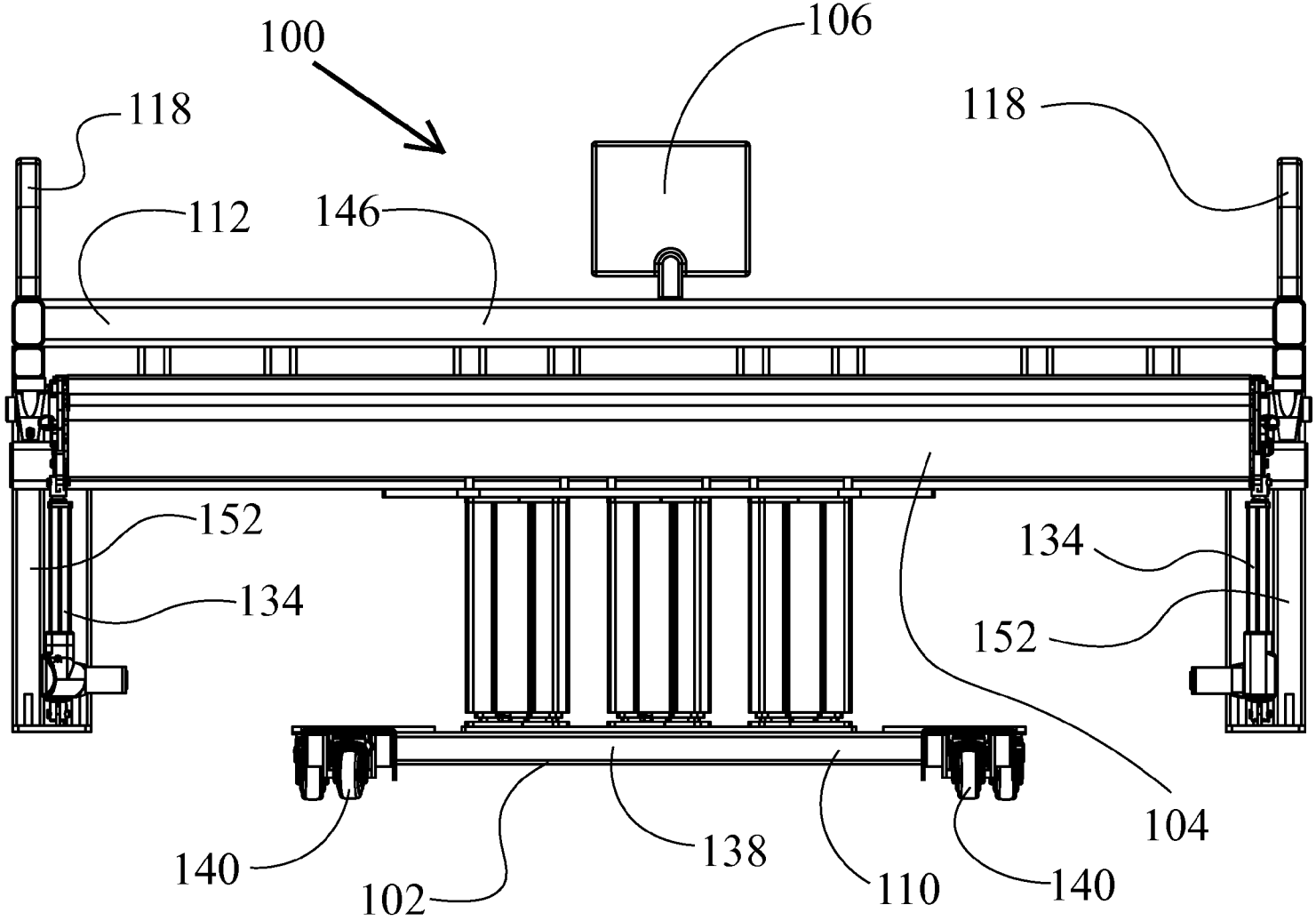
FIG. 3 is a front view of the patient transfer device according to one embodiment of the present invention.

Embodiments of invention comprise a patient transfer device and an associated method of transferring a patient using the device. The device is used anytime a patient needs to be moved or transferred out of bed especially in those circumstances wherein the patient is in any way incapacitated and is unable to move or assist in the transfer. The device transfers the patient laterally from a longitudinal side of the bed onto the device. The transfer can be accomplished with minimal medical staff interaction and as such significantly and substantially reducing the risk or injury and harm not only for the patient but also the staff.

Generally, the transfer device has a C-shaped frame comprising a wheeled base, lifting columns rising upwardly from base and terminating in framework for supporting a conveyor unit assembly that is configured to both transfer a patient and support the patient when he/she has been transferred there on. The leg portion is typically height adjustable to properly align to any height bed or surface provided there is clearance for the wheeled base. Safety railings are provided on all sides of the frame to protect the patient from rolling off when being transported but the front safety rail is configured to be moved from the loading side of the device to facilitate the transfer operation. Front railing (not shown) rotates from front while patient is being transported. When patient is being loaded the railing pivots back and tucks alongside the non-one of the left and right sides of the device until patent is loaded on the device.

The conveyor unit assembly comprises separate upper and lower conveyor units that in operation rotate in an opposite direction relative to the other but at substantially the same speed. In the assembly, the upper and lower units are joined together to facilitate cooperative operation. The lower conveyor is configured to pull or push the device onto or off of an elevated bed or similar elevated top surface while the base is drawn under the bed or surface. The upper conveyor unit is configured to move the patient to and from the bed or other top surface.

In the loading and unloading configuration, the conveyor assembly unit is canted at a slight approach angle off of horizontal to better facilitate conveying the patient on or off the device. This loading angle also allows for the lower conveyor to drive parallel to the transfer surface. Embodiments of the transfer device include an option to pivot to a fully horizontal position during transfer typically after the patient is completely loaded thereon.

Embodiments of the patient transfer device are designed to easily permit a full wash down when necessary for sanitary reasons as is desirable in a hospital setting. The device does not having exposed recesses and locations where water and cleaning solution could pool and stagnate for long periods of time. In some embodiments to access to all surfaces and areas of the device, the conveyor bases can be pivoted into a wash down configuration that loosens the conveyor belts and allow easier access to the backsides of the belt and the surfaces there beneath.

At least some embodiments of the device are powered by deep cycle rechargeable batteries while other variations can be AC powered or have the capability to use both AC and battery power. Control of the electrical systems is typically provided by way of either or both a handheld interface pendant control and one or more touch screen displays.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," "upper," "lower" and "below," as used in this specification and appended claims, refer to relative positions of identified elements, components, or objects, where the components or objects are oriented in an upright position as normally installed or used.

The term "arcuate" as used herein refers to a curved surface or line. The curved surface or line need not comprise an arc or portion of circle, but may also comprise a portion of an oval or other shape comprising a curved surface. Accordingly, the terms "radius" and "effective radius" refer to the radius a circle that most closely matches with the referenced arcuate surface or line.

The phrase "integrally formed" or the term "integral" as used herein refers to something that is a portion of the whole. For instance, integrally formed portions are portions of the whole that are formed from the same base material and at essentially the same time as the whole.

The term "patient" as used herein refers to a person on which the patient transfer device can be used to move the person from one location to another. The term is not to be interpreted as limiting any description or claim to use only with people who are patients of a medical institution or medical practitioner.

The term "conveyor" or the phrase "conveyor unit" refers to a system using an endless belt (including endless tracks) rotated around opposing and spaced apart ends wherein the ends typically, but not necessarily, comprise rollers.

An Embodiment of a Patient Transfer Device Assembly

An embodiment of a fully assembled patient transfer device 100 is illustrated in FIGS. 1-4 & 10 & 11. The major components/assemblies comprising the system include a C-shaped support frame 102, a conveyor unit assembly 104, and an electrical system including various motors, actuators and associated controllers, which are largely housed in or also a constituent of one of the conveyor unit assembly or the C-shaped support frame. A touch screen 106 that can be used to control the operation of the device is illustrated in the referenced figures.

Figure 11:
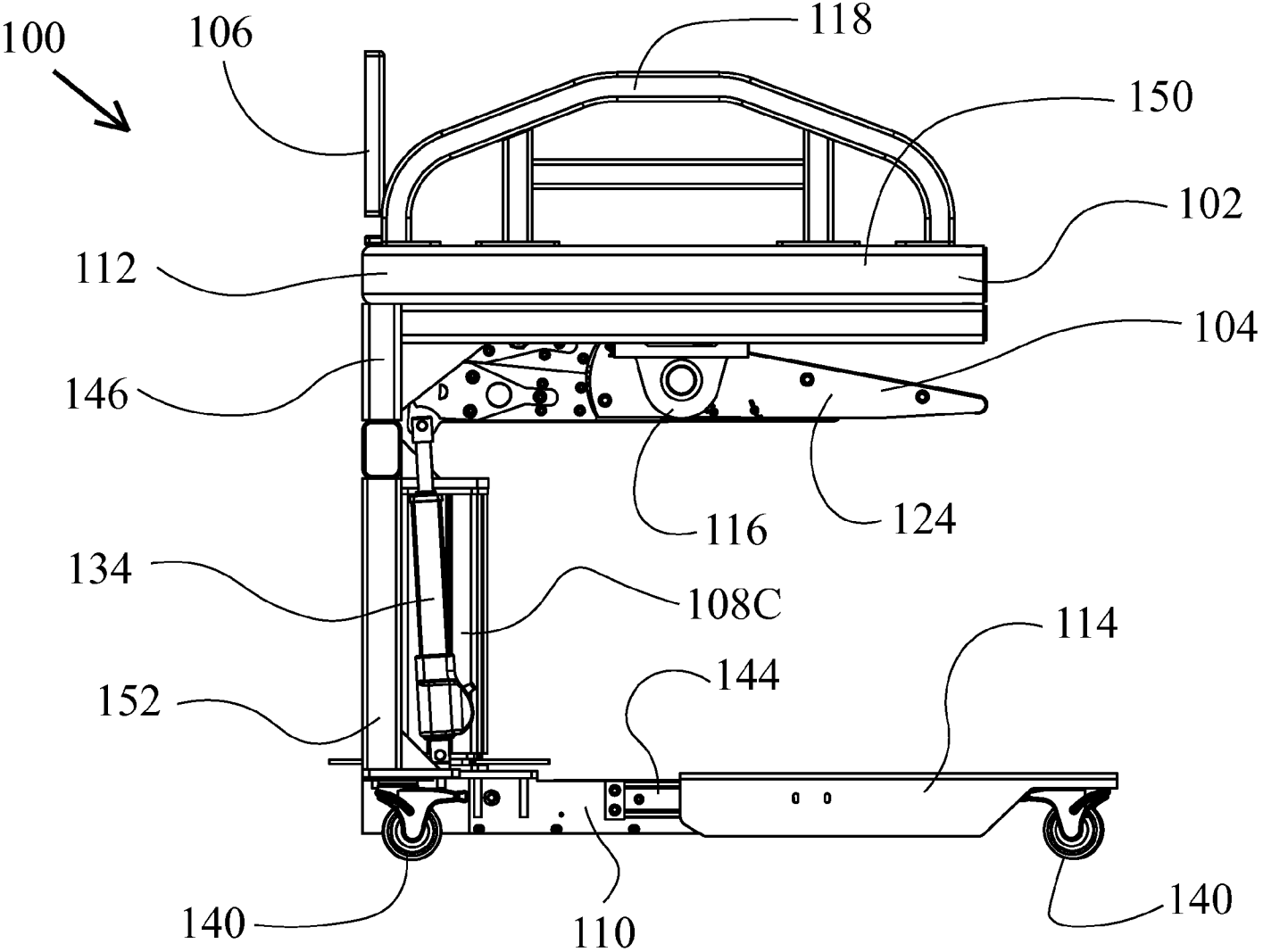
FIG. 11 is a side view of the patient transfer device with the conveyor assembly in the extended orientation for patient loading and unloading and the wheeled base in the extended position according to one embodiment of the present invention.

Generally, the frame unit 102 comprises a C-shape having a plurality of substantially vertical lifting columns 108A-C that that span between a wheeled base 110 and an upper frame portion 112 adapted to receive the conveyor unit assembly 104. The C-shape permits the wheeled base to be drawn under the bed or other surface from which a patient is being transferred there by contributing to the stability of the device as a person is loaded on or off of it. To further enhance stability end beams 114 of the wheeled base 110 can extend outwardly of the remainder of the base as best illustrated in FIG. 11. The three lifting columns comprise telescoping portions that are slidably coupled to permit linear actuators within the outer two lifting columns to raise and lower the upper portion of the frame. The upper frame portion serves two primary functions: (1) to pivotally support the conveyor unit assembly by way of bearing mounts 116; and (2) to provide safety railings 118. A front safety railing (not shown in the Figs) is also typically provided but is removable and/or movable to permit the loading and unloading of a patient. In some variations, the front safety railing (not shown) can be pivoted and locked in place along the longitudinal front edge of the conveyor unit assembly while patent is being transported and can be pivoted to non-loading left or right side of the frame unit when loading patient.

The conveyor unit assembly 104 comprises upper and lower conveyor units 120 & 122 that are mechanically joined together at each end by mounting plates 124 and associated fasteners. The mounting plates also include pivots shafts 126 extending outwardly there from for receipt into the bearing mounts 116 to pivotally couple the conveyor unit assembly to the upper frame portion 112. Each conveyor unit includes separate belts and drive motors. The motors are synced through the controllers of the electrical system to rotate the conveyors at the same linear speed albeit in opposite directions.

The electrical/control system 128 includes but is not limited to the linear actuators (not shown) located in one or more of the vertical lifting columns, the drive motors 130 & 132 in the upper and lower conveyor units 120 & 122, the touch screen display 106, linear actuators 134 coupled to the frame and the conveyor unit assembly 104 for effecting the tilt thereof, actuator motors 136 for the extension and retraction of the wheel base end beams 114, controllers and associated logic for controlling the operation of the various components, one or more batteries, and circuitry for recharging the batteries along with all necessary wires and electrical traces operatively connecting the electrical components.

A Frame Unit of the Patient Transfer Device

FIGS. 5-9 show various views of the frame unit. As mentioned above the frame unit comprises a wheeled base 110 and an upper frame portion 112 joined together by three vertical lifting columns 108A-C.

The wheeled base 110 comprises a generally C-shaped framework forming a platform 138 along the rear thereof. The three vertical lifting columns 108A-C rest upon and are mounted to the top of the platform. Mounted on the underside of the platform on opposite ends there of are wheeled casters 140. In some variations of the patient transfer device, a drive wheel 142 with an associated motor may be mounted under the center of the platform to facilitate powered movement of the device whether during patient transfer to and from the device as well as the propulsion of the device from one location to another (see FIG. 15). In other variations, the device is moved by being pushed or pulled by medical personnel.

From each respective end of the rear platform, the end beams 114 extend forwardly to form the C-shaped wheeled base. The end beam is slidably coupled to the remainder of the wheeled base 110 by way of sliders 144, which through the use of an associated linear actuator can be moved forwardly into an extended position relative to the platform about 6"-12" from a retracted position. A wheeled caster 140 is mounted to the underside of each end beam to provide support for the frame unit and the patient transfer device.

Figure 12:
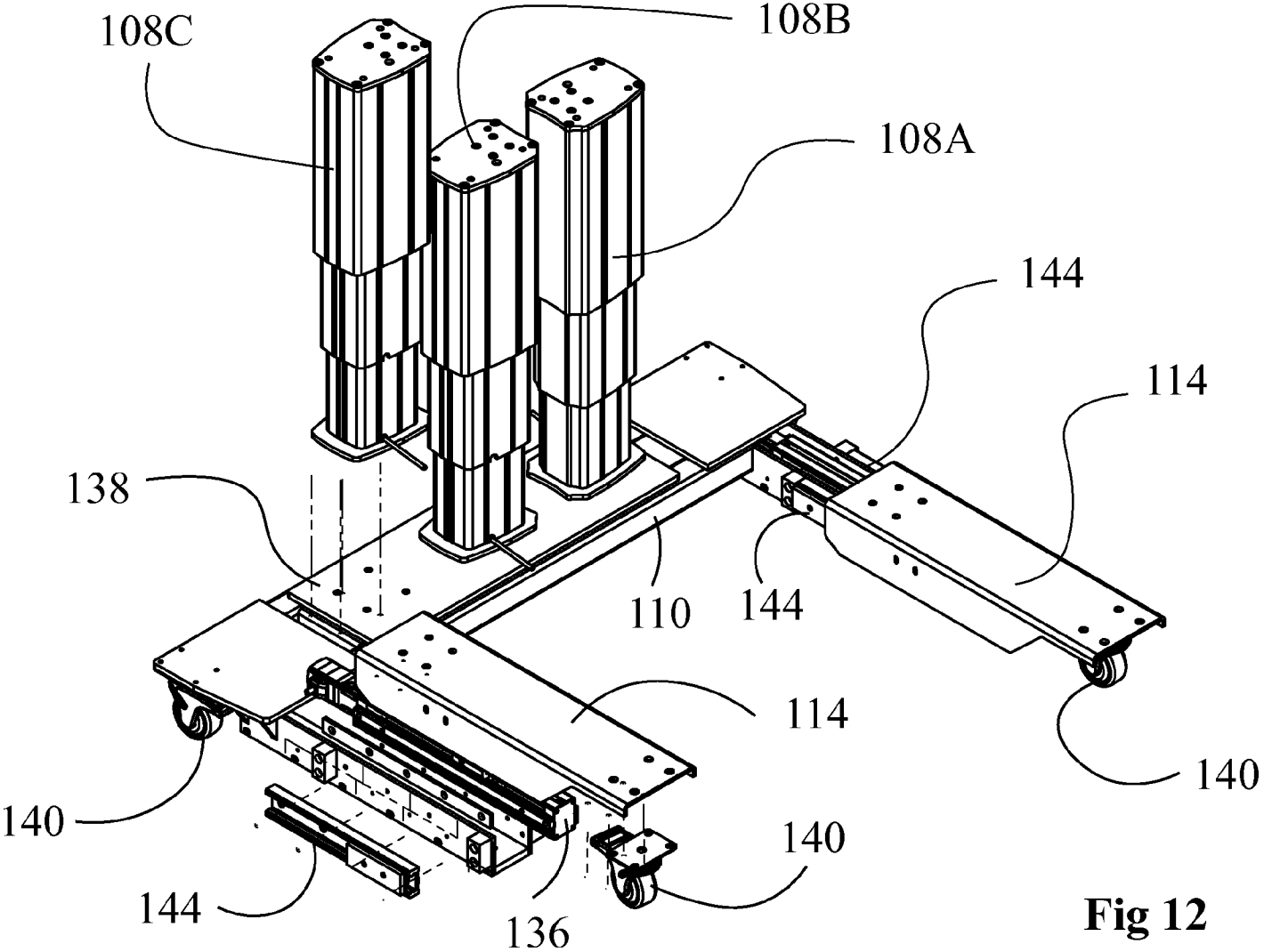
FIG. 12 is a partial perspective view of the frame unit showing the lifting columns and the wheeled base according to one embodiment of the present invention.

FIG. 12 shows an exploded view of an end beam along with the associated wheeled caster 140 and linear actuator 136.

Figure 13:
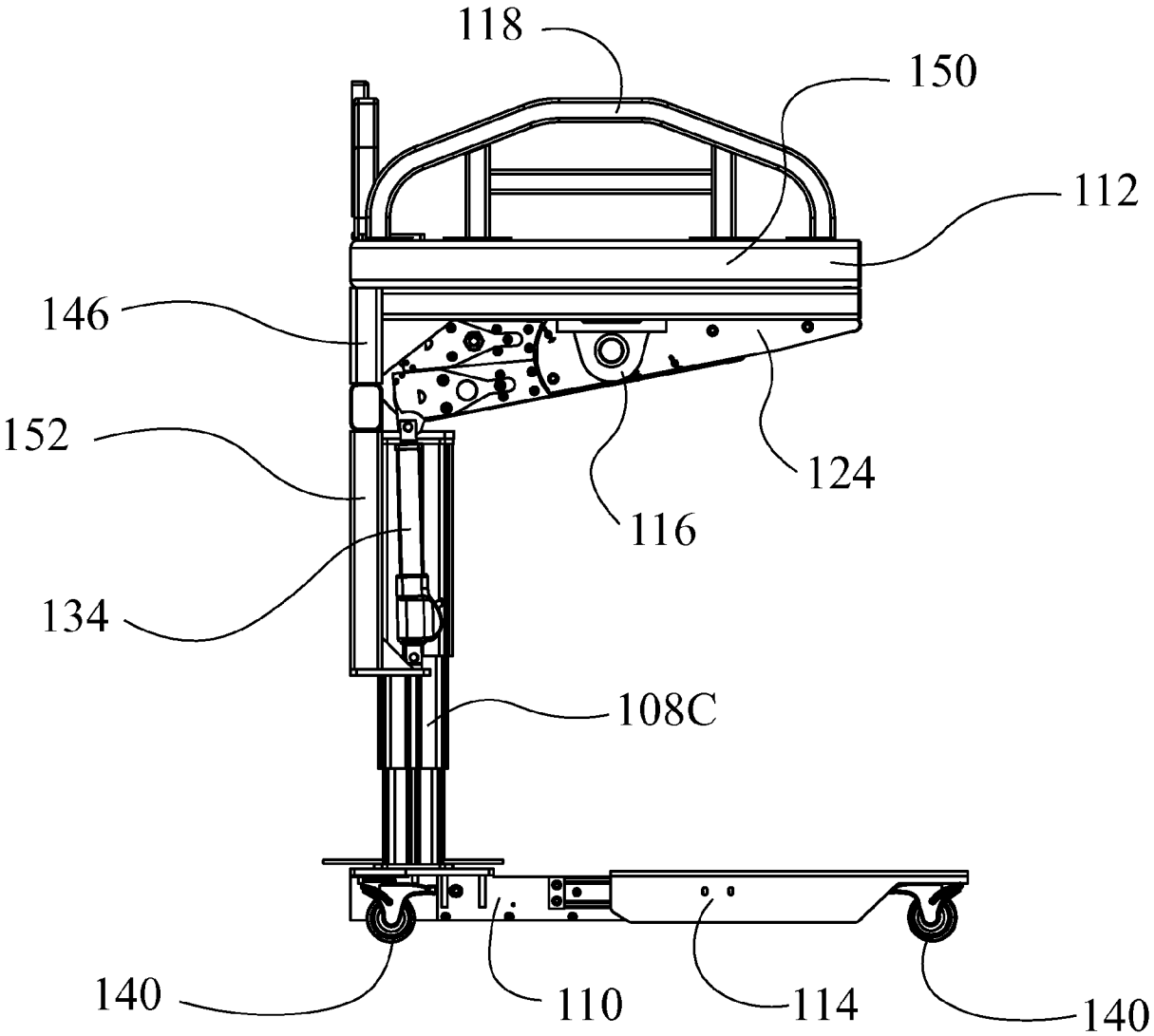
FIG. 13 is a side view of the Patient Transfer Device showing the lifting columns and the leg beams each in extended positions according to one embodiment of the present invention.
Figure 14:
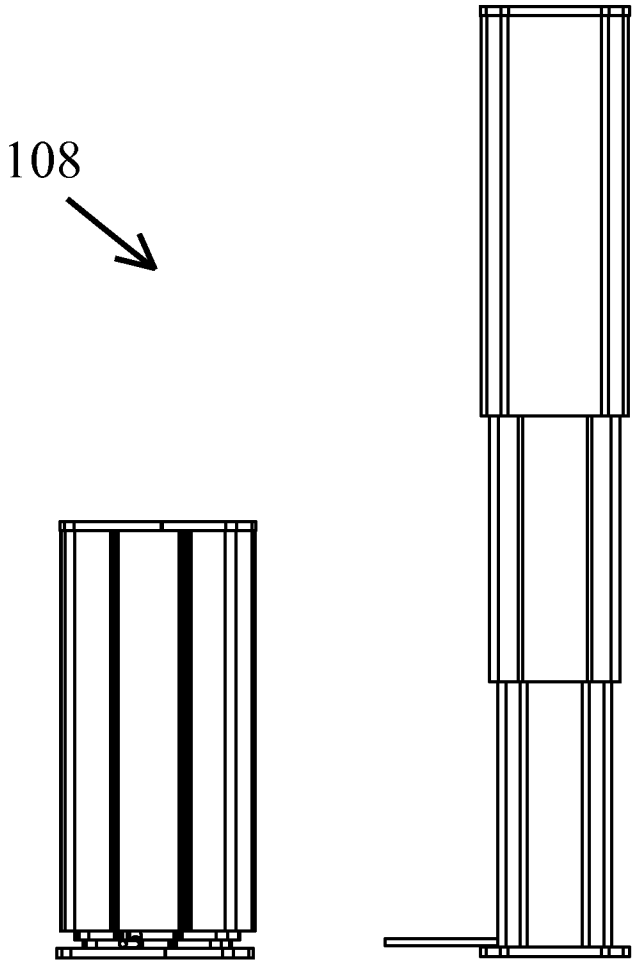
FIG. 14 is a side view of a lifting column showing the column in retracted and telescoped extended configurations according to one embodiment of the present invention.

Each of the vertical lifting columns 108A-C comprises three nested tubular members that together can telescope to increase in length as is best shown in FIGS. 12 & 14. Contained within at least one but typically two of the lifting columns are linear actuators that act to lengthen and shorten the lifting columns and accordingly raise and lower the upper frame portion 112 of the frame unit 102. A battery pack and/or a controller can be housed in the internal cavity of the one or more lifting columns that do not contain a linear actuator. For reference, FIG. 13 shows the patient transfer device 100 in an elevated position with the lifting columns telescopically extended.

The upper frame portion 112 comprises a girder beam 146 that is mounted to the topside of the vertical lifting columns by way of a mounting plate 148. The girder beam extends outwardly from the lifting columns ultimately having a length greater than the length of the wheeled base and most typically at least a little bit longer than the length of a typical hospital bed mattress. From each of the left and right ends of the girder beam, an upper leg 150 extends orthogonally, substantially horizontally and forwardly. Also from each end of the girder beam, a tilt actuator beam 152 extends downwardly with the tilt actuator beam terminating at a location vertically at least several inches above the bottom of the wheeled castors or an underlying floor when the vertical lifting columns are fully retracted.

The girder beam 146 typically comprises a pair of spaced horizontally-extending square or rectangular tubing that is joined by vertical tubes spaced along the length thereof. The girder beam also acts as a safety railing when a patient is resident on the device substantially preventing the patient from rolling or sliding off the backside of the surface of the upper conveyor unit. As shown in the various Figs, a touch screen control interface 106 can be mounted to the top side of the girder beam.

Each horizontal upper leg 150 extends a length comfortably greater than the width of a patient that might be transported on the device. The safety railing 118 is typically mounted to the topside of each leg, and the bearing mount 116 is secured to the bottom side about midway along its length. The bearing mount is configured to pivotally receive a corresponding pivot shaft 126 of the conveyor unit assembly 104.

Figure 4:
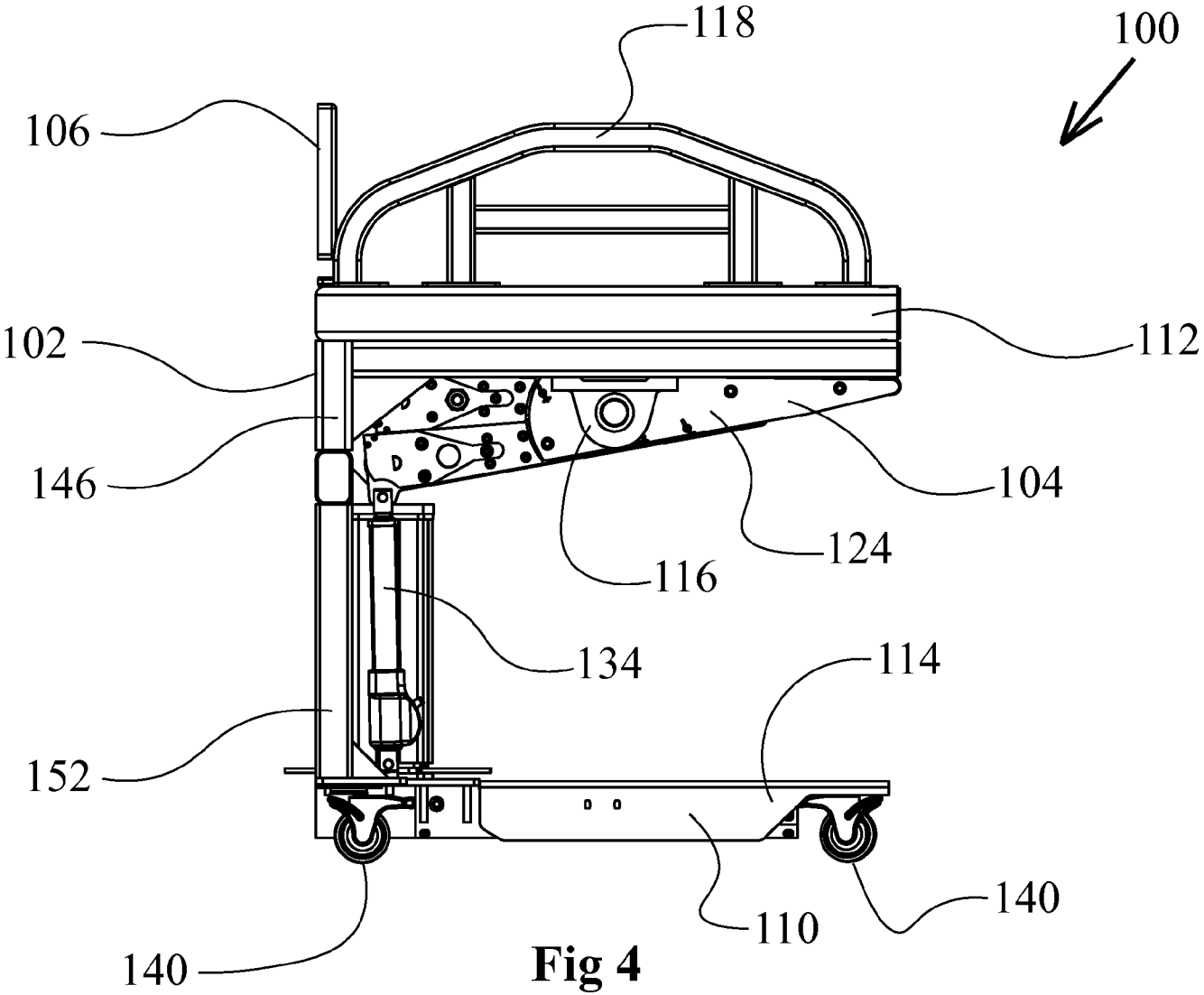
FIG. 4 is a side view of the patient transfer device according to one embodiment of the present invention.
Figure 5:
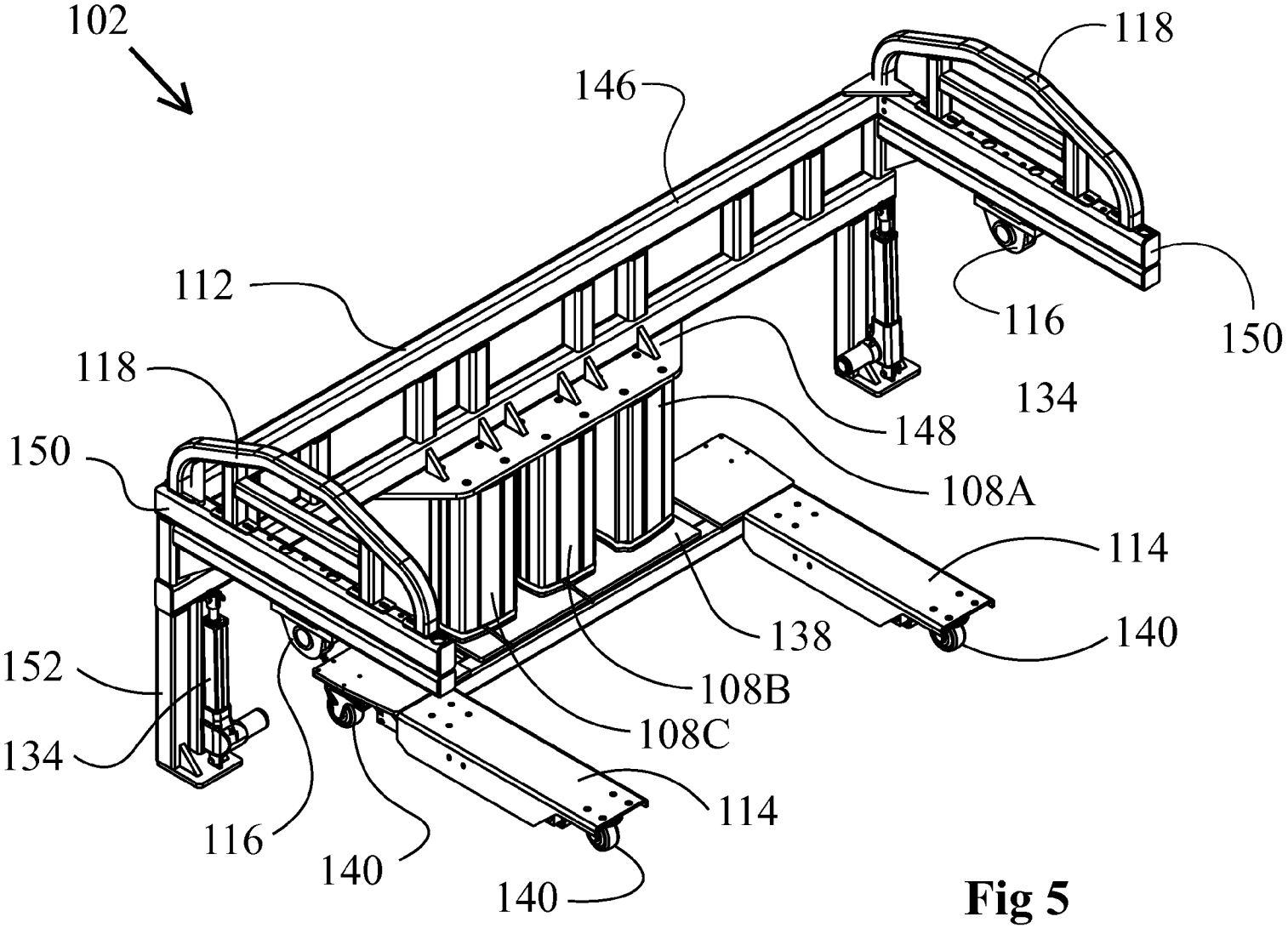
FIG. 5 is a perspective front view of the frame unit of the patient transfer device according to one embodiment of the present invention.
Figure 6:
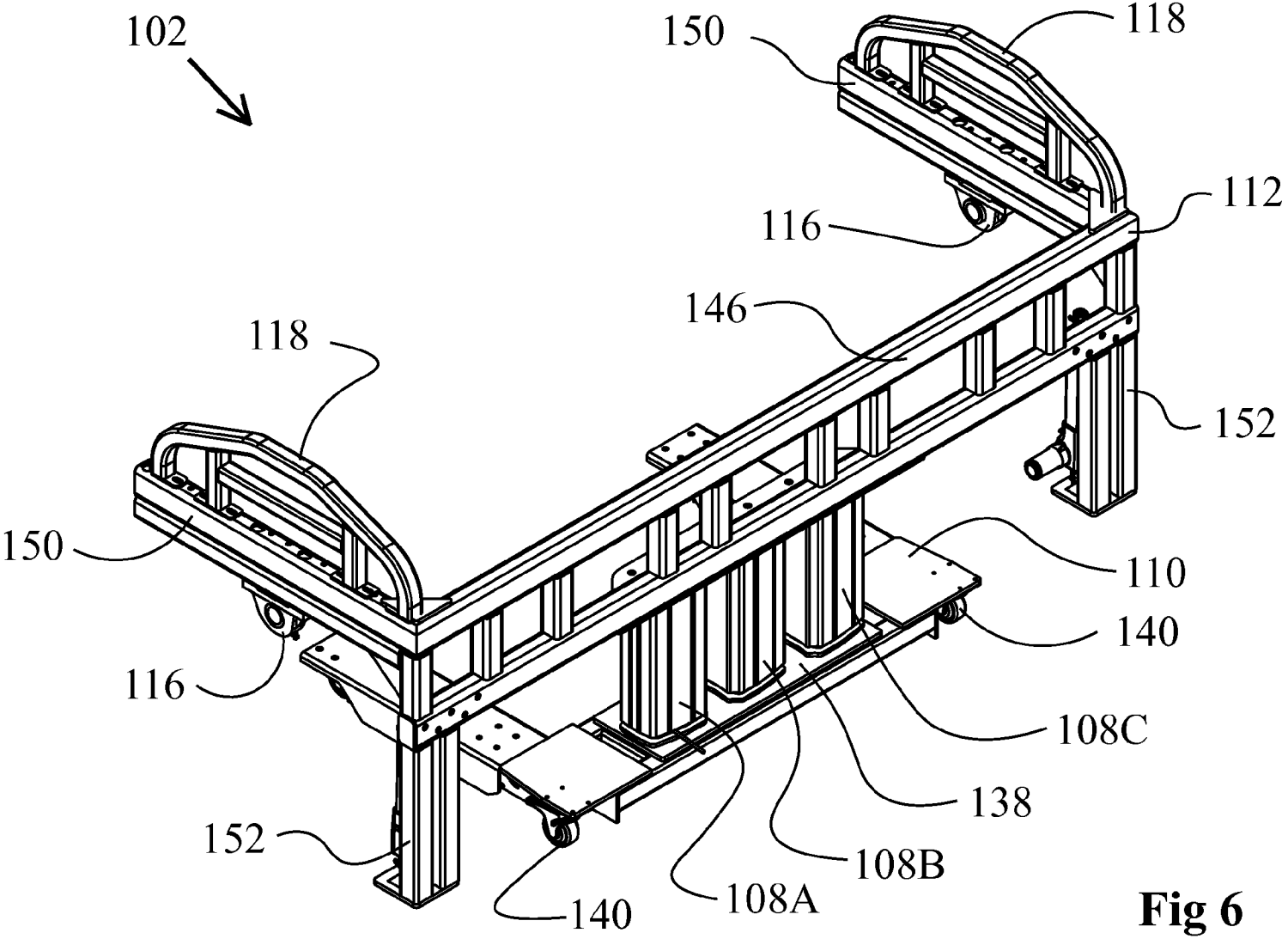
FIG. 6 is a perspective rear view of the frame unit of the patient transfer device according to one embodiment of the present invention.
Figure 7:
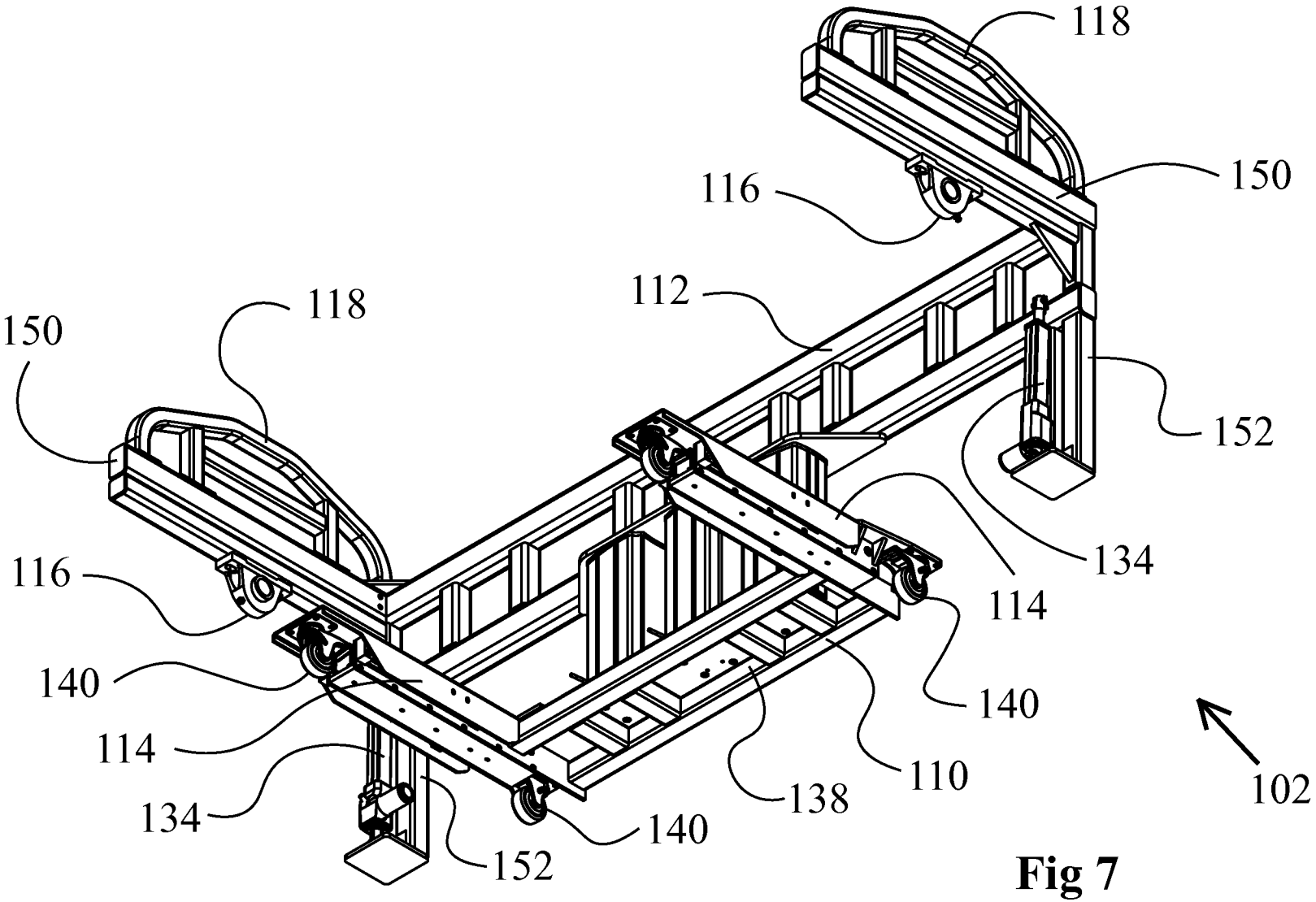
FIG. 7 is a perspective bottom view of the frame unit of the patient transfer device according to one embodiment of the present invention.
Figure 8:
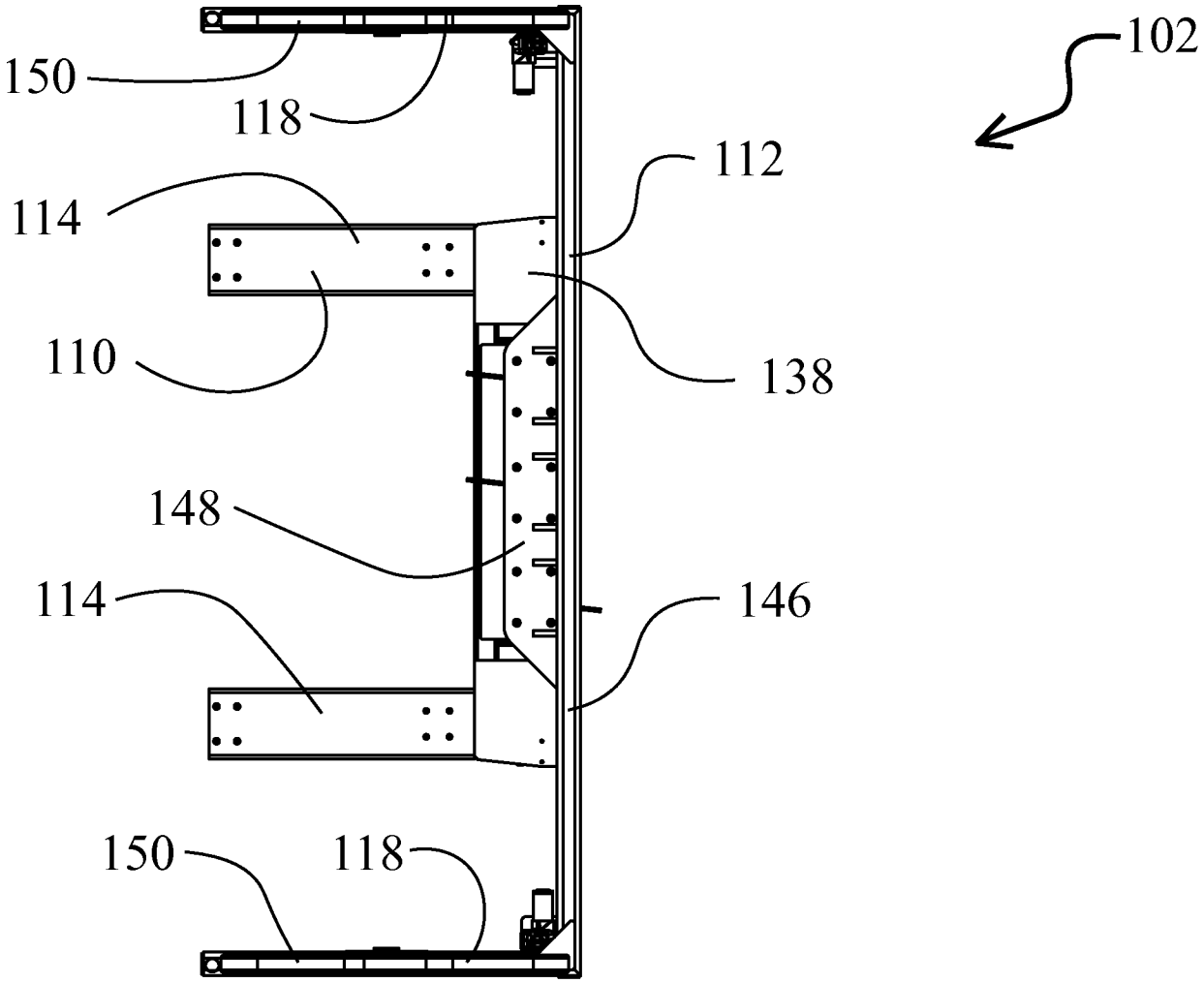
FIG. 8 is a top view of the frame unit of the patient transfer device according to one embodiment of the present invention.
Figure 9:
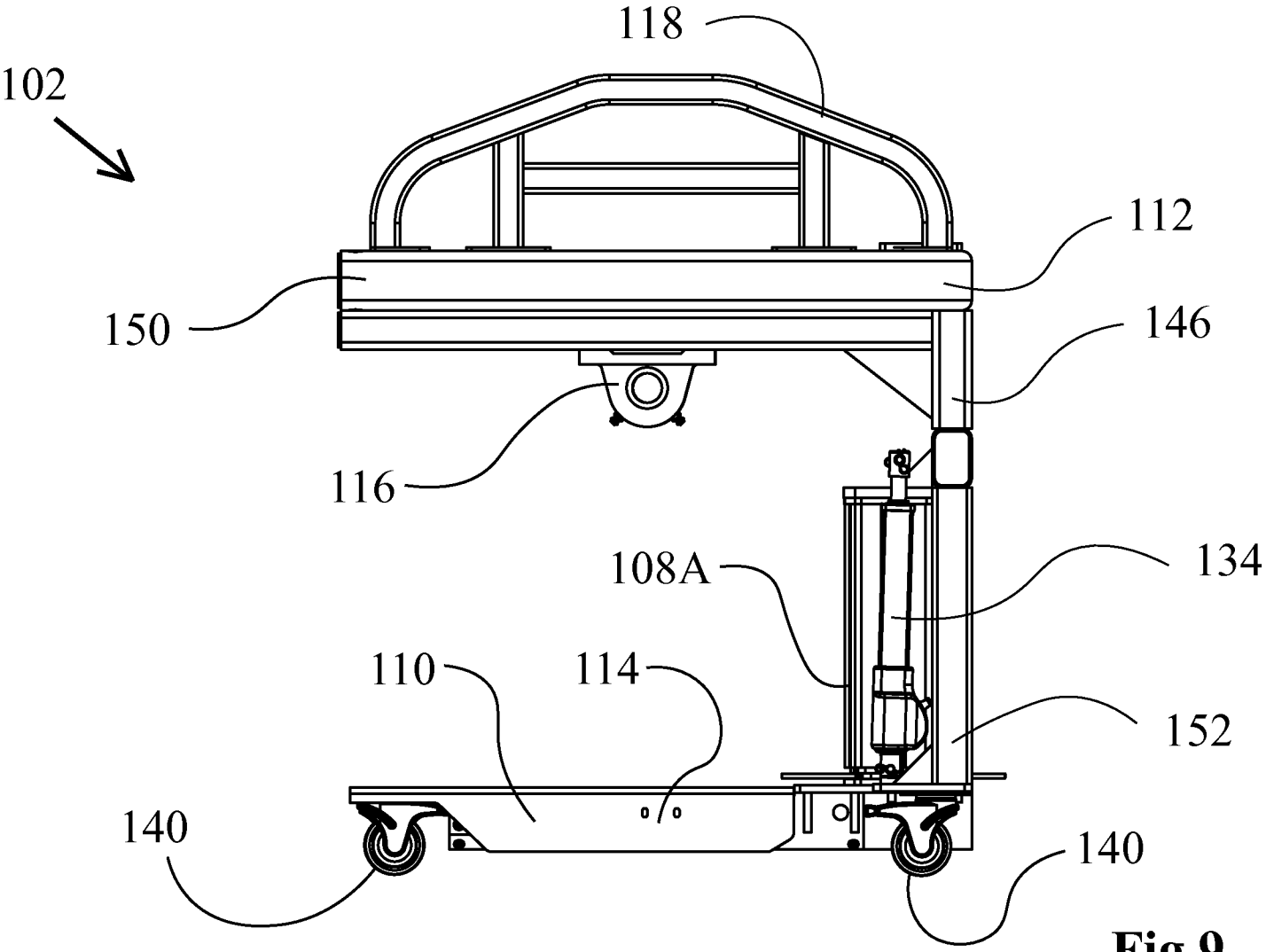
FIG. 9 is a side view of the frame unit of the patient transfer device according to one embodiment of the present invention.
Figure 10:
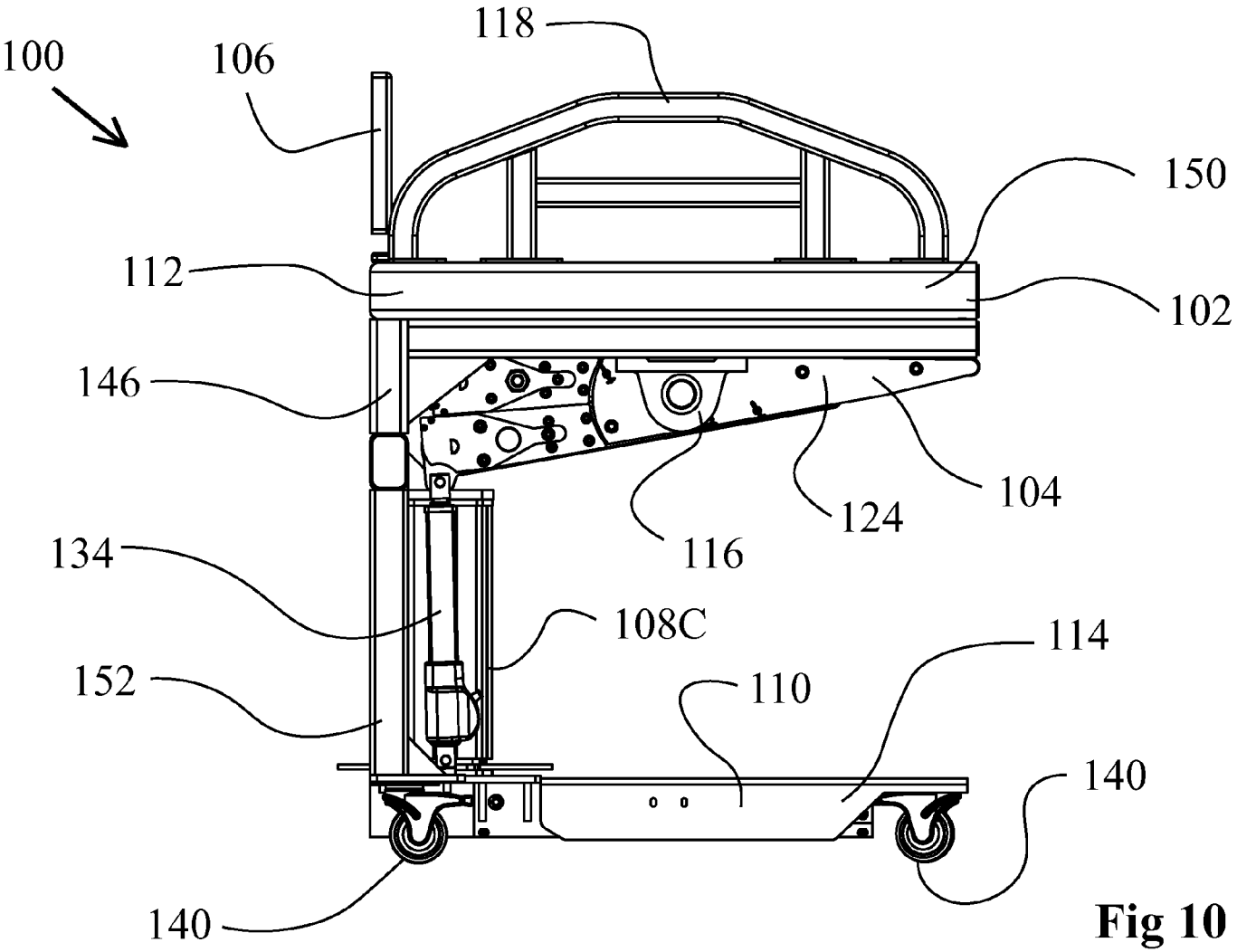
FIG. 10 is a side view of the patient transfer device with the conveyor assembly in the retracted orientation for transport and the wheeled base in the retracted position according to one embodiment of the present invention.

Each tilt actuator beam 152 is configured to pivotally receive at its bottom end a bottom end of a linear actuator 134 of which the actuator's top end is pivotally coupled to the conveyor unit assembly 104 as seen in FIG. 4 for example. Actuation of the actuator permits the movement of the conveyor unit assembly between a loading/unloading orientation and a transport orientation as will be described supra.

Figure 15:
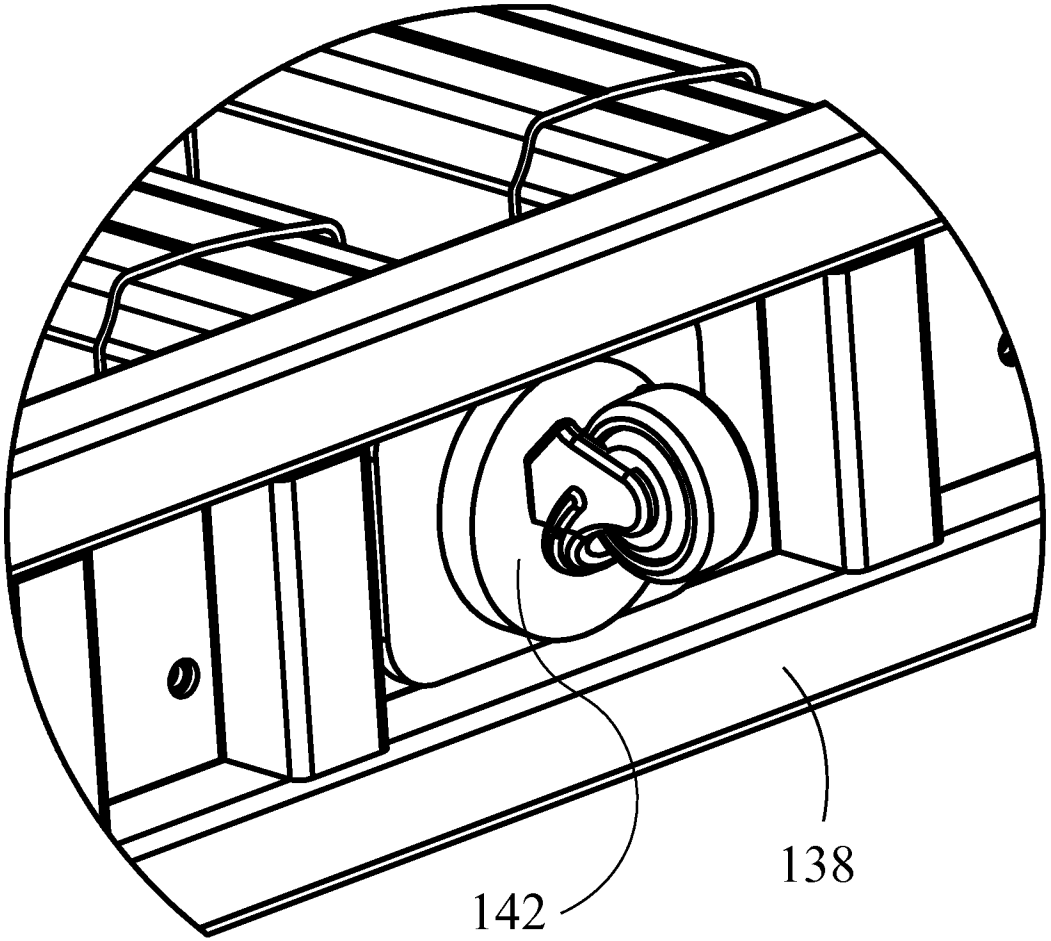
FIG. 15 is a partial perspective bottom view of the frame unit showing a center drive wheel according to one embodiment of the present invention.
Figure 16:
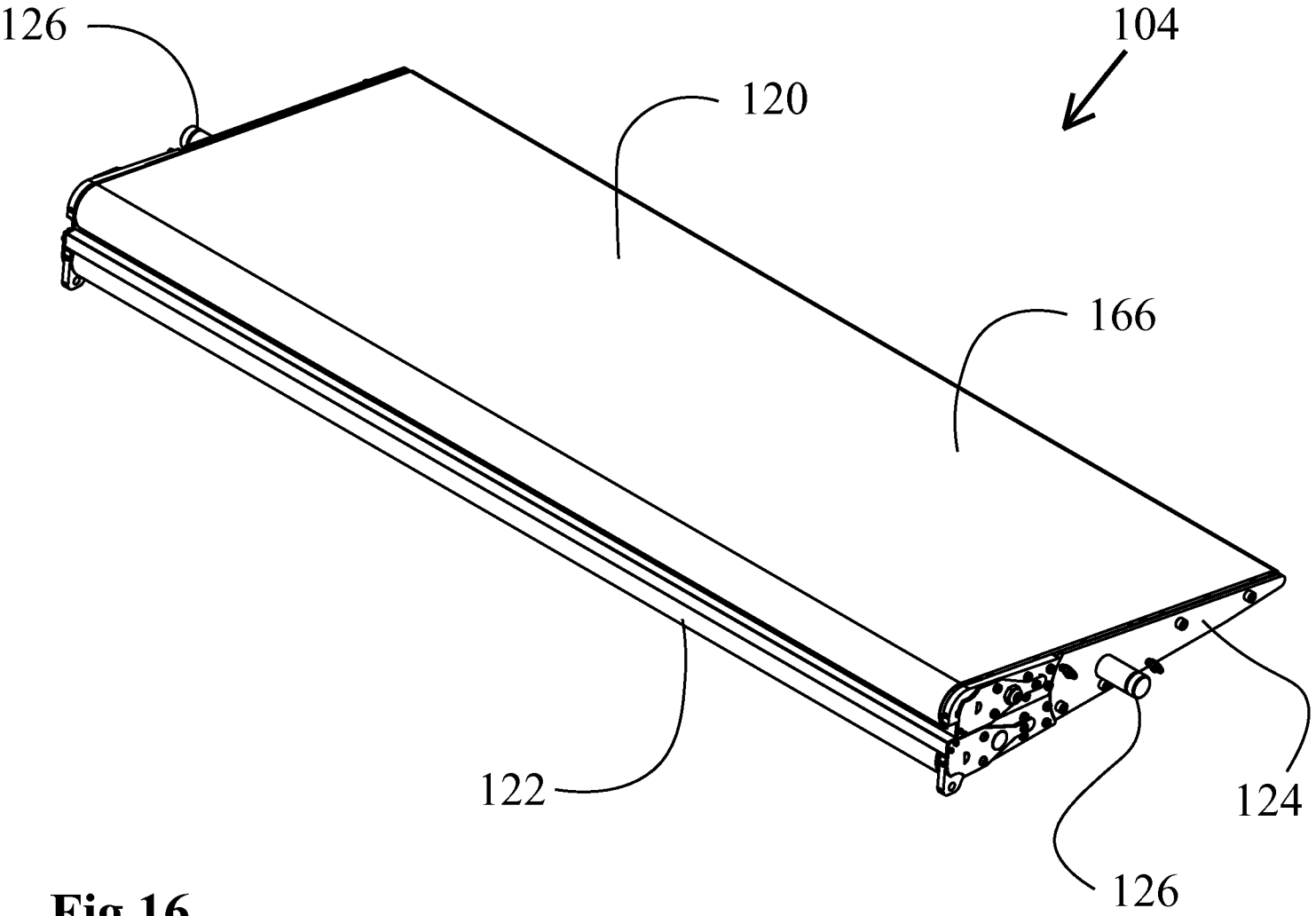
FIG. 16 is a perspective top rear view of the conveyor unit assembly of the patient transfer device according to one embodiment of the present invention.
Figure 17:
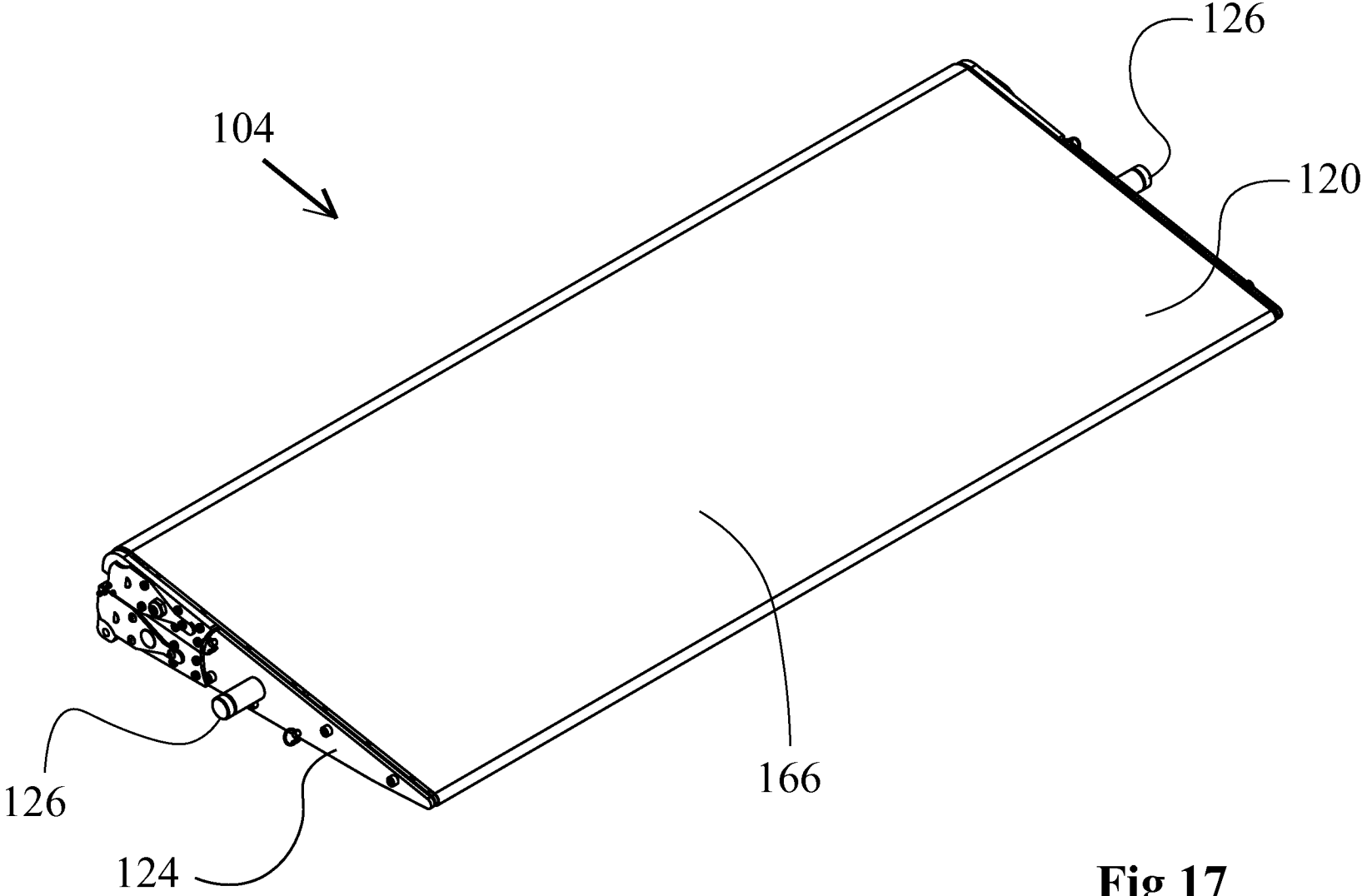
FIG. 17 is a perspective front view of the conveyor unit assembly of the patient transfer device according to one embodiment of the present invention.
Figure 18:
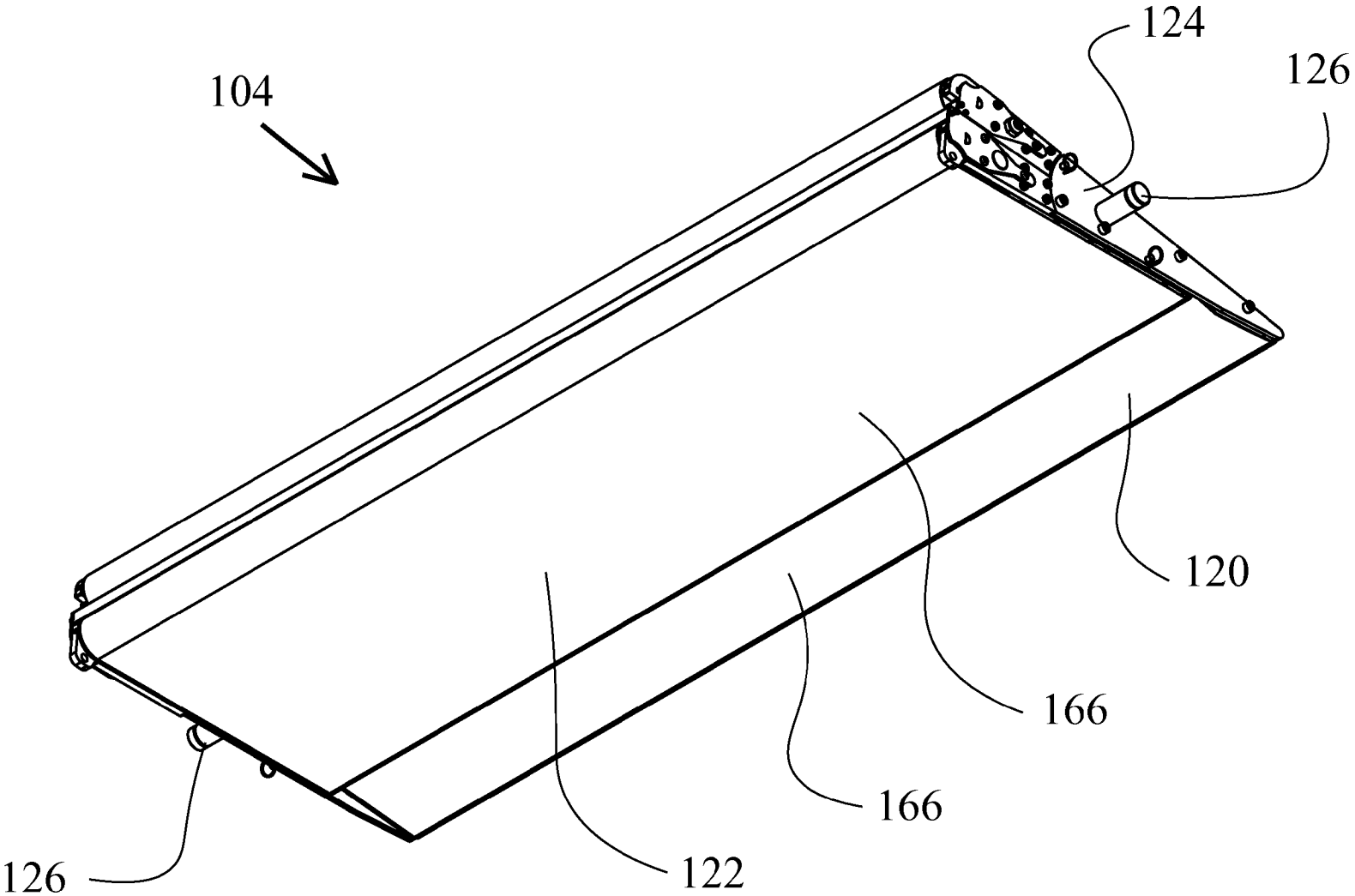
FIG. 18 is a perspective bottom rear view of the conveyor unit assembly of the patient transfer device according to one embodiment of the present invention.
Figure 19:
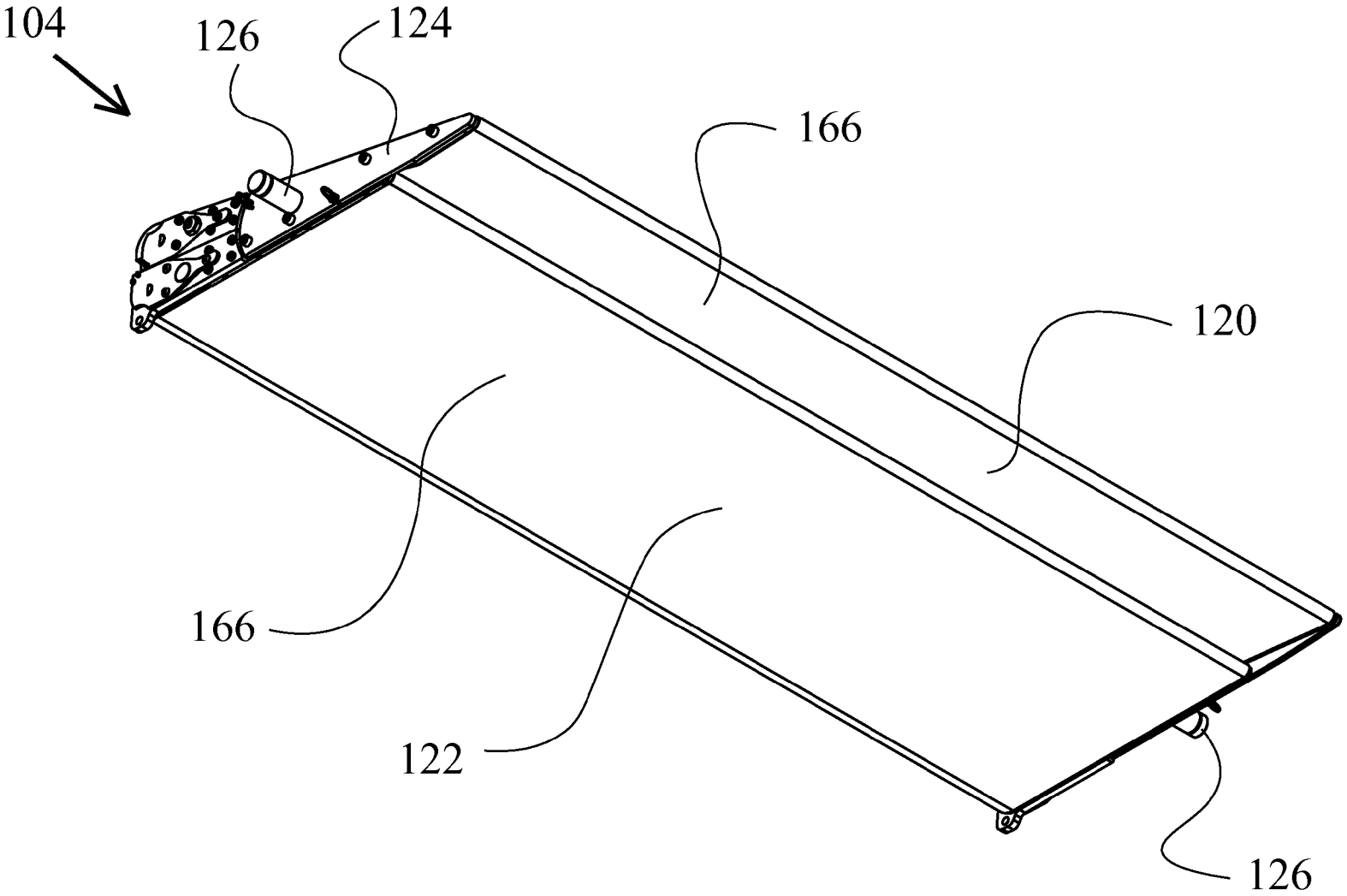
FIG. 19 is a perspective bottom front view of the conveyor unit assembly of the patient transfer device according to one embodiment of the present invention.

In some variations of the patient transfer device 100, one or more drive wheels are provided to assist in or independently propel the device. As shown in FIG. 15 a drive wheel 142 can be placed near the center of the wheeled base 110 and include motors to both turn the wheel and control is direction. The drive wheel motors can be controlled by way of one or more of the user interfaces. In one variation, the motor can be configured to automatically activate and assist in the propulsion of the device when being pushed by a person.

The frame unit 112 can be comprised of any suitable material or a combination of suitable materials, although typically the frame unit is comprised primarily of a metal material such as steel or aluminum. Further, the exact configuration of the frame unit can change substantially from what is depicted herein while maintaining a C-shape as is best shown in the side view illustration of FIG. 9 that permits the attached conveyor unit assembly to crawl onto the top surface of a hospital bed (or other surface) while the wheeled base is pulled underneath the bed.

A Conveyor Unit Assembly of the Patient Transfer Device

Figure 23:
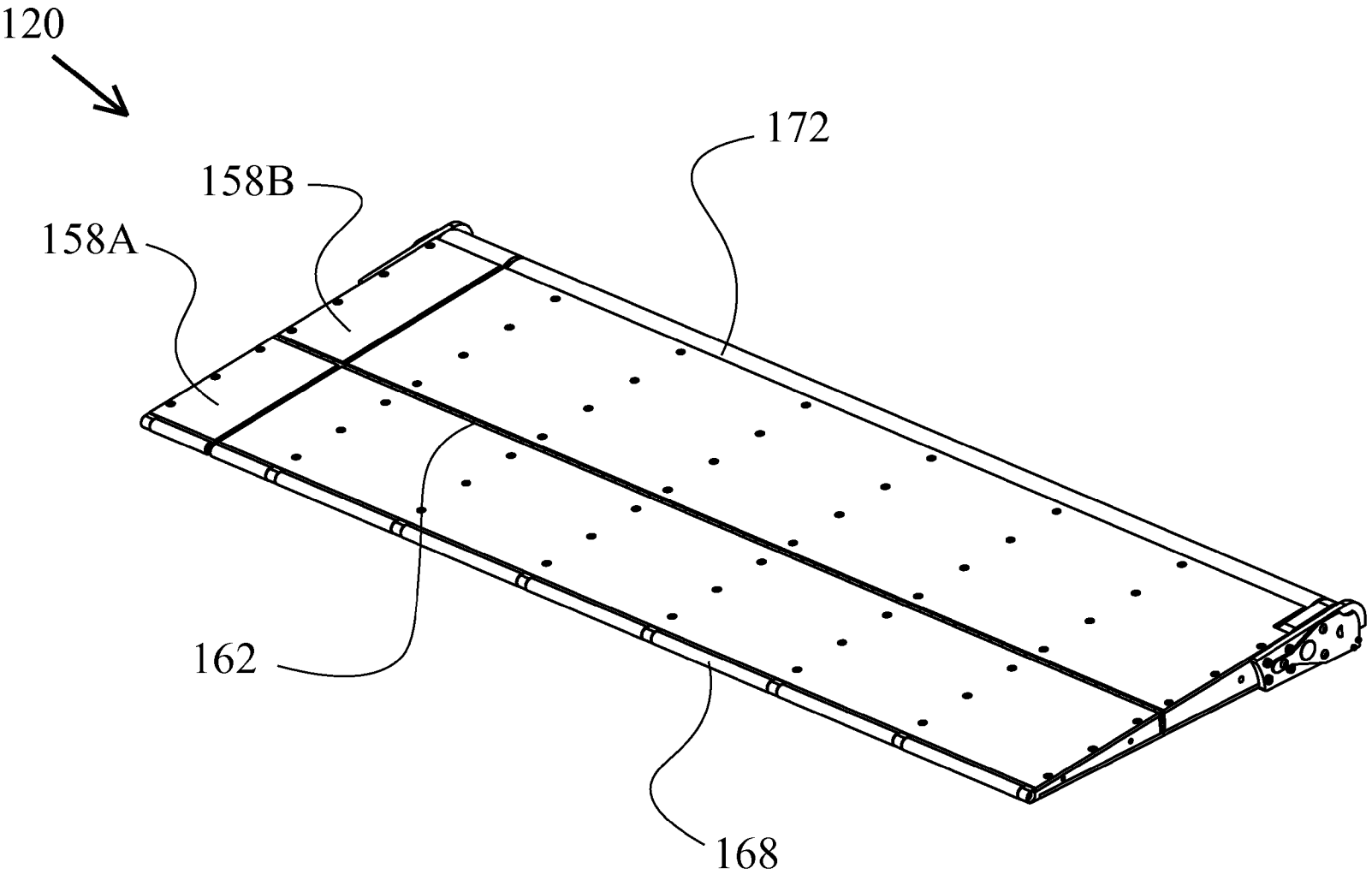
FIG. 23 is a perspective top view of the upper conveyor unit of the conveyor unit assembly sans the upper conveyor belt according to one embodiment of the present invention.
Figure 24:
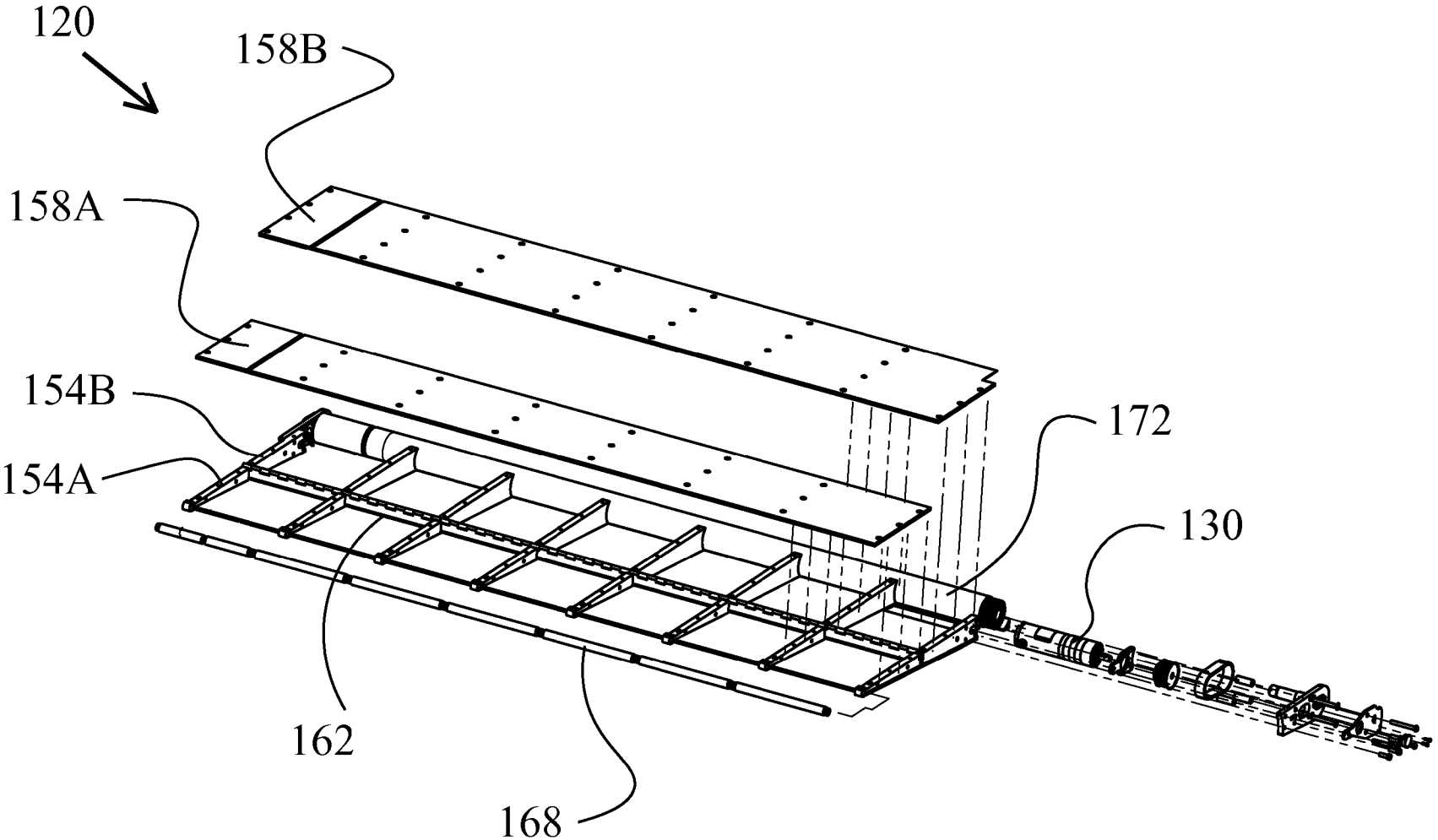
FIG. 24 is an exploded perspective top view of the upper conveyor unit of the conveyor unit assembly sans the upper conveyor belt according to one embodiment of the present invention.
Figure 25:
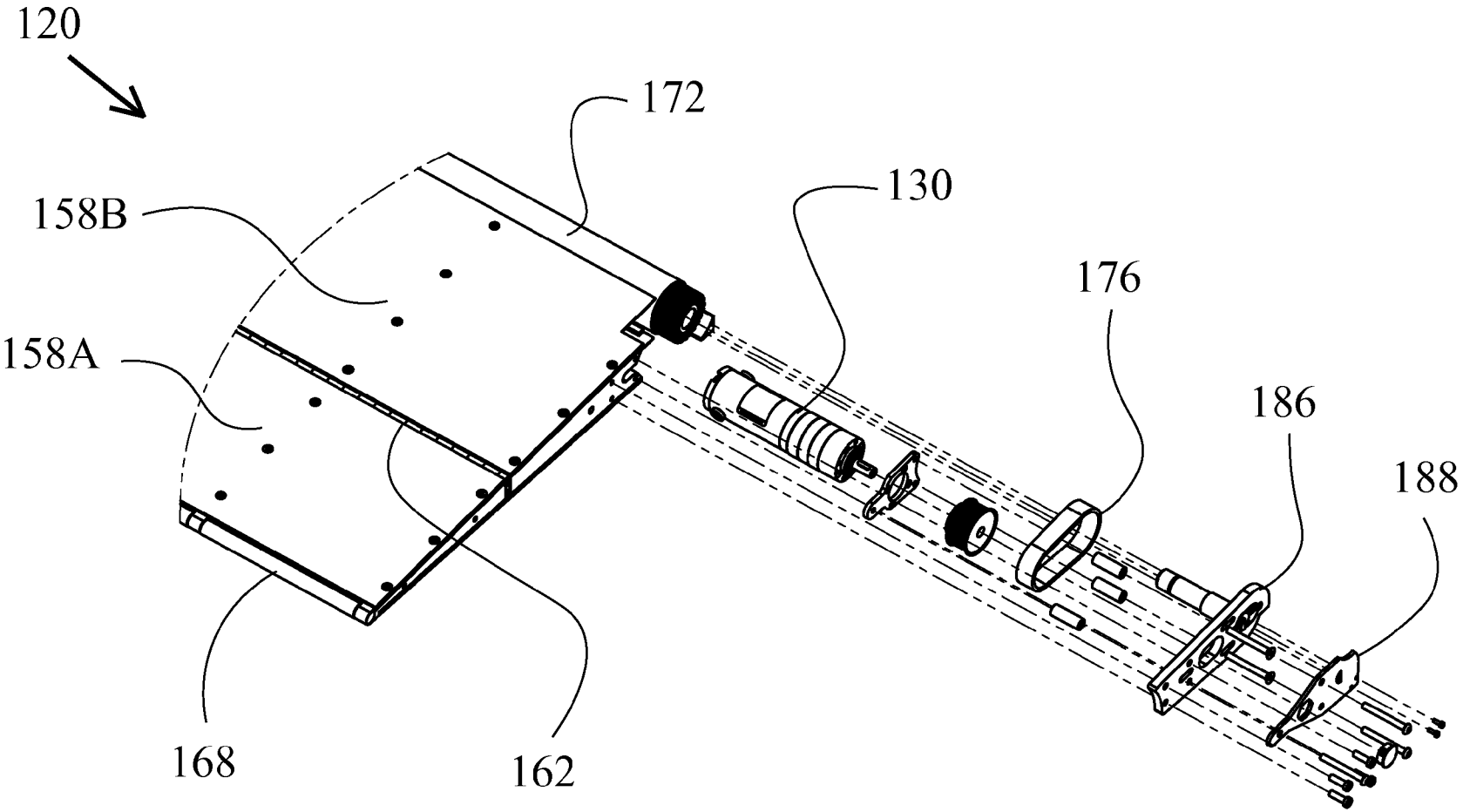
FIG. 25 is a partial perspective top view of the upper conveyor unit of the conveyor unit assembly sans the upper conveyor belt showing the drive motor according to one embodiment of the present invention.
Figure 26:
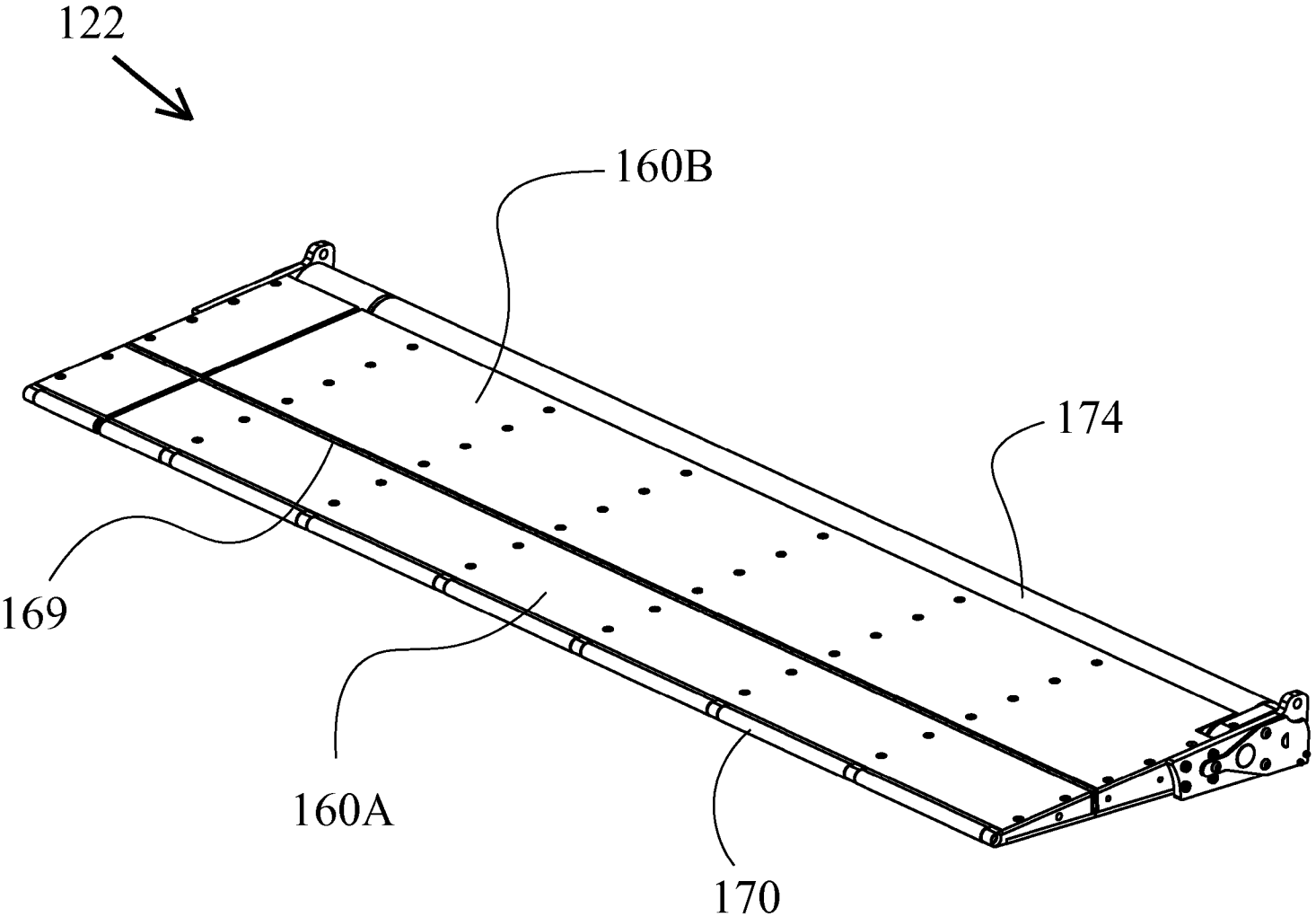
FIG. 26 is a perspective top view of the lower conveyor unit of the conveyor unit assembly sans the lower conveyor belt according to one embodiment of the present invention.
Figure 27:
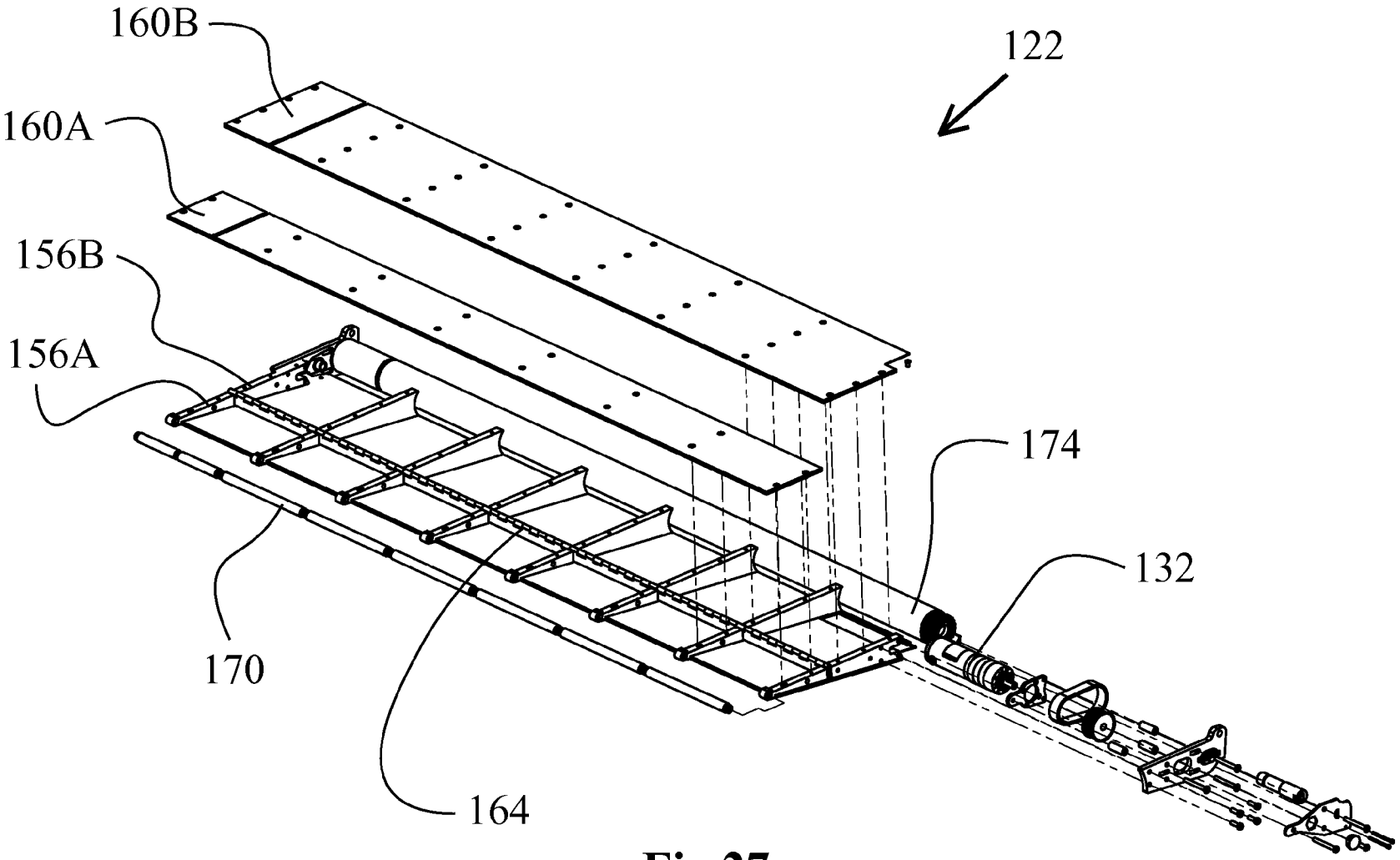
FIG. 27 is an exploded perspective top view of the lower conveyor unit of the conveyor unit assembly sans the lower conveyor belt according to one embodiment of the present invention.
Figure 28:
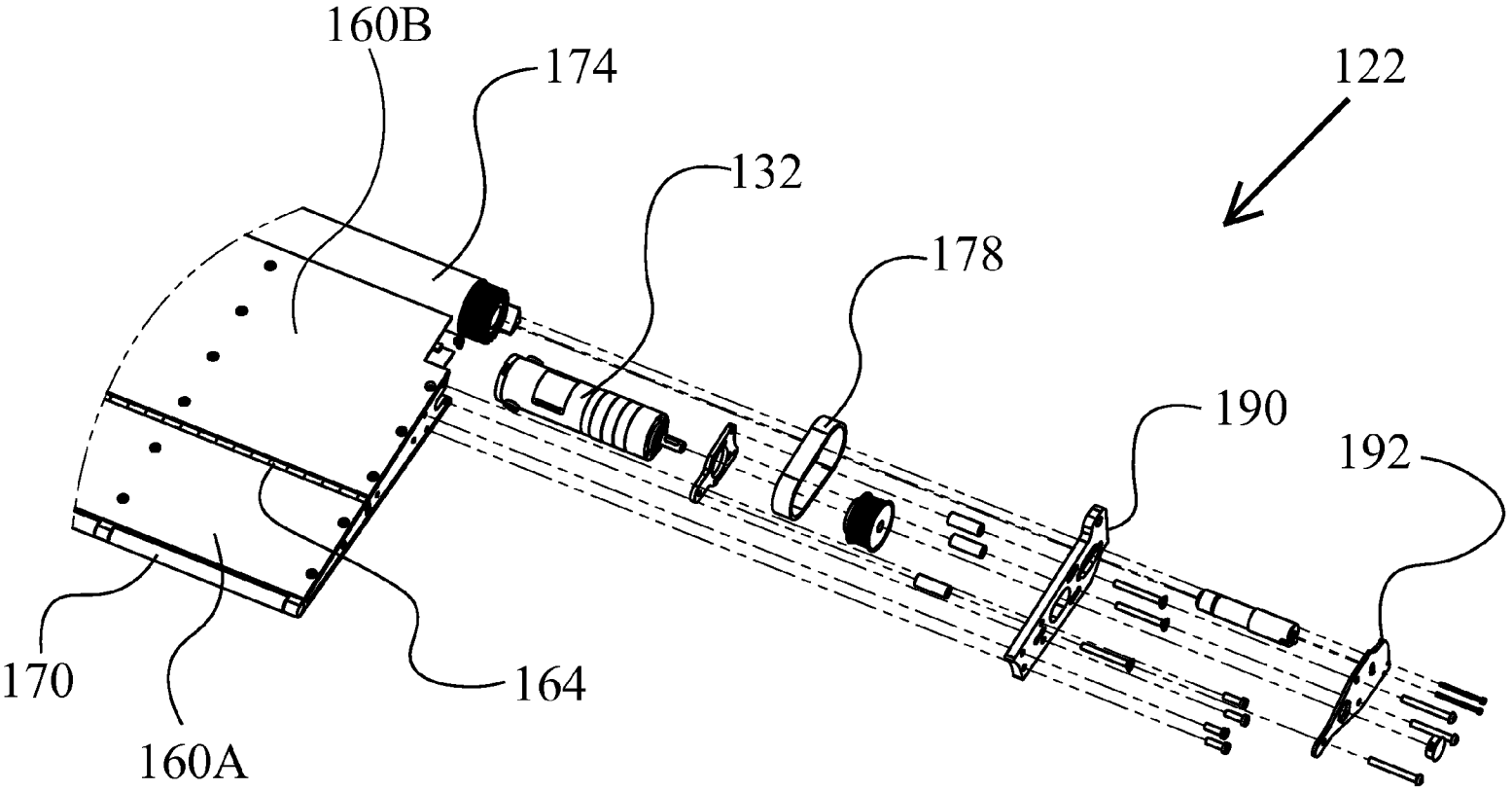
FIG. 28 is a partial perspective top view of the lower conveyor unit of the conveyor unit assembly sans the lower conveyor belt showing the drive motor according to one embodiment of the present invention.

The conveyor unit assembly 104 is illustrated in FIGS. 16-22 and comprises separately driven upper and lower conveyor units 120 & 122. FIGS. 23-25 are illustrations of the upper conveyor unit, and FIGS. 26-28 are illustrations of the lower conveyor unit. The upper conveyor acts to move and transfer the patient to and from the patient transfer device 100 while the lower conveyor acts to move the device relative to the hospital bed. The conveyors which have separate motors 130 & 132 and operate independently of each other; however, in operation they are typically driven in unison as the motors are controlled by the system controller. The conveyor units are coupled together by a pair of mounting plates 124 (best seen in FIG. 20) that also include the pivot shafts 126 by which the assembly is pivotally secured to the frame unit 112.

Each conveyor unit 120 & 122 comprises a truss frame 154A&B & 156A&B over which guide plates are secured 158A&B & 160A&B. The truss frames are tapered being thickest at the rear and thinnest at the front end. Each truss frame comprises front portions 154A & 156A and rear portions 154B & 156B that are pivotally connected by way of a hinge 162 & 164 that runs the entire length of the unit permitting each unit to be moved into a cleaning configuration as will be described supra. Front guide plates 158A & 160A are attached to the front truss portion 154A & 156A, and rear guide plates 158B & 160B are attached to the rear truss portion 154B & 156B. The guide plates provide surfaces over which the conveyor belts 166 can easily slide. The plates are located on the top side of the upper conveyor unit 120 and on the bottom side of the lower conveyor unit. At the thinner front edge of each conveyor unit one or more rollers 168 & 170 are provided around which the conveyor belt transitions from one of the top and bottom surfaces to the other. At the rear edge a motor-driven large roller 172 & 174 is provided. The electric drive motor 130 & 132 is mounted forward and adjacent to the large roller and operatively coupled with it by way of a drive belt 176 & 178.

With reference to FIGS. 24 & 28, a slot is provided in the plates 158 & 160 that runs laterally proximate the left side. A similarly configured slot wrap circumferentially around the rollers 168-174 proximate their left ends. Correspondingly shaped male protrusions are provided on the undersides of the endless belts 166. The male protrusions are matingly received in the slots to keep the conveyor belts properly aligned.

Both conveyor units 120 & 122 are of substantially similar lengths permitting them to be easily joined together at the ends by the side mounting plates 124. However, the lower conveyor unit has a shorter width than the upper conveyor unit such that when the two are joined together. This configuration reflects the fact that a patient is going to be laying in several inches at the minimum from the edge of a bed.

Figure 20:
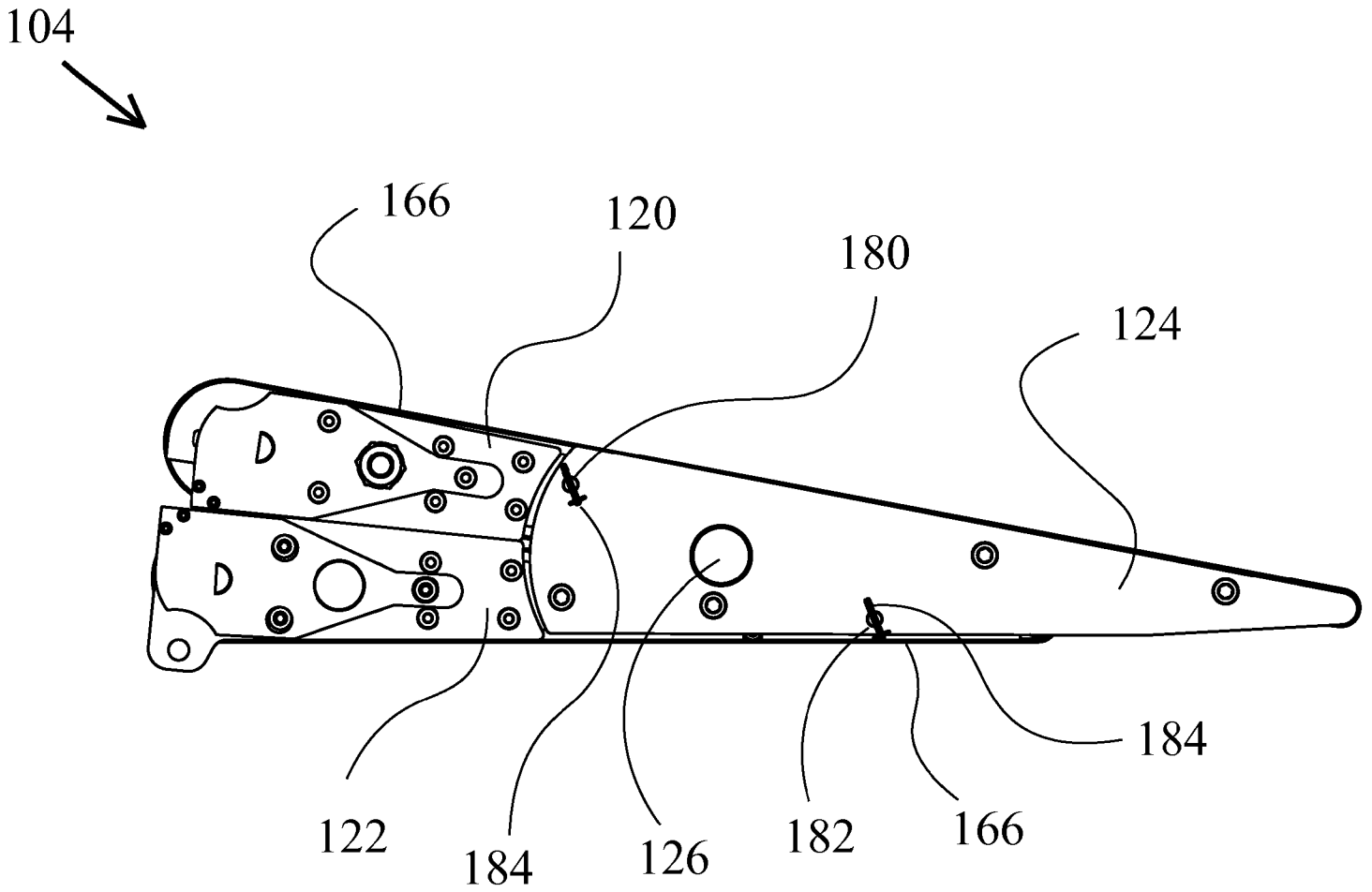
FIG. 20 is a side view of the conveyor unit assembly of the patient transfer device according to one embodiment of the present invention.
Figure 21:
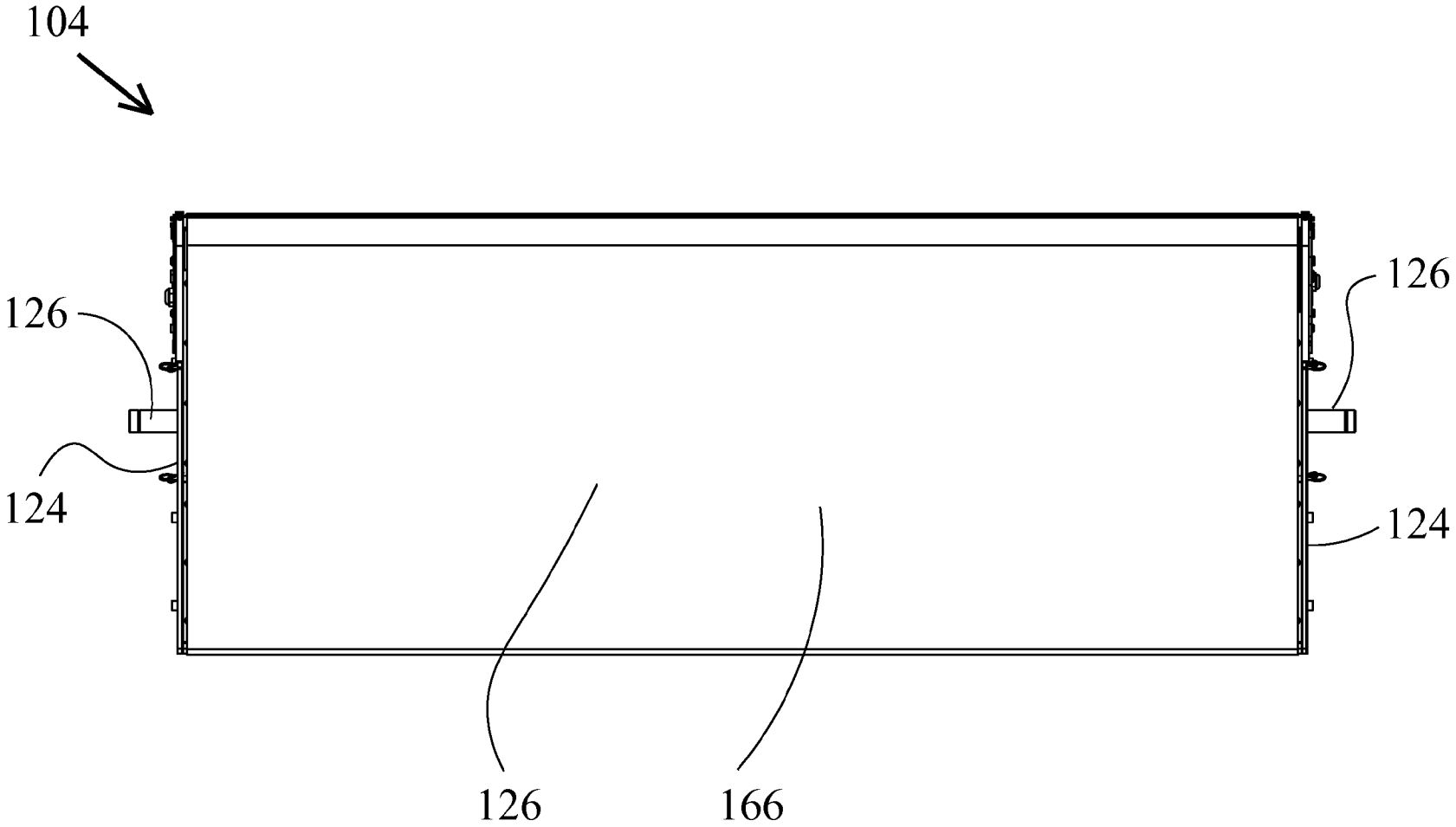
FIG. 21 is a top view of the conveyor unit assembly of the patient transfer device according to one embodiment of the present invention.
Figure 22:
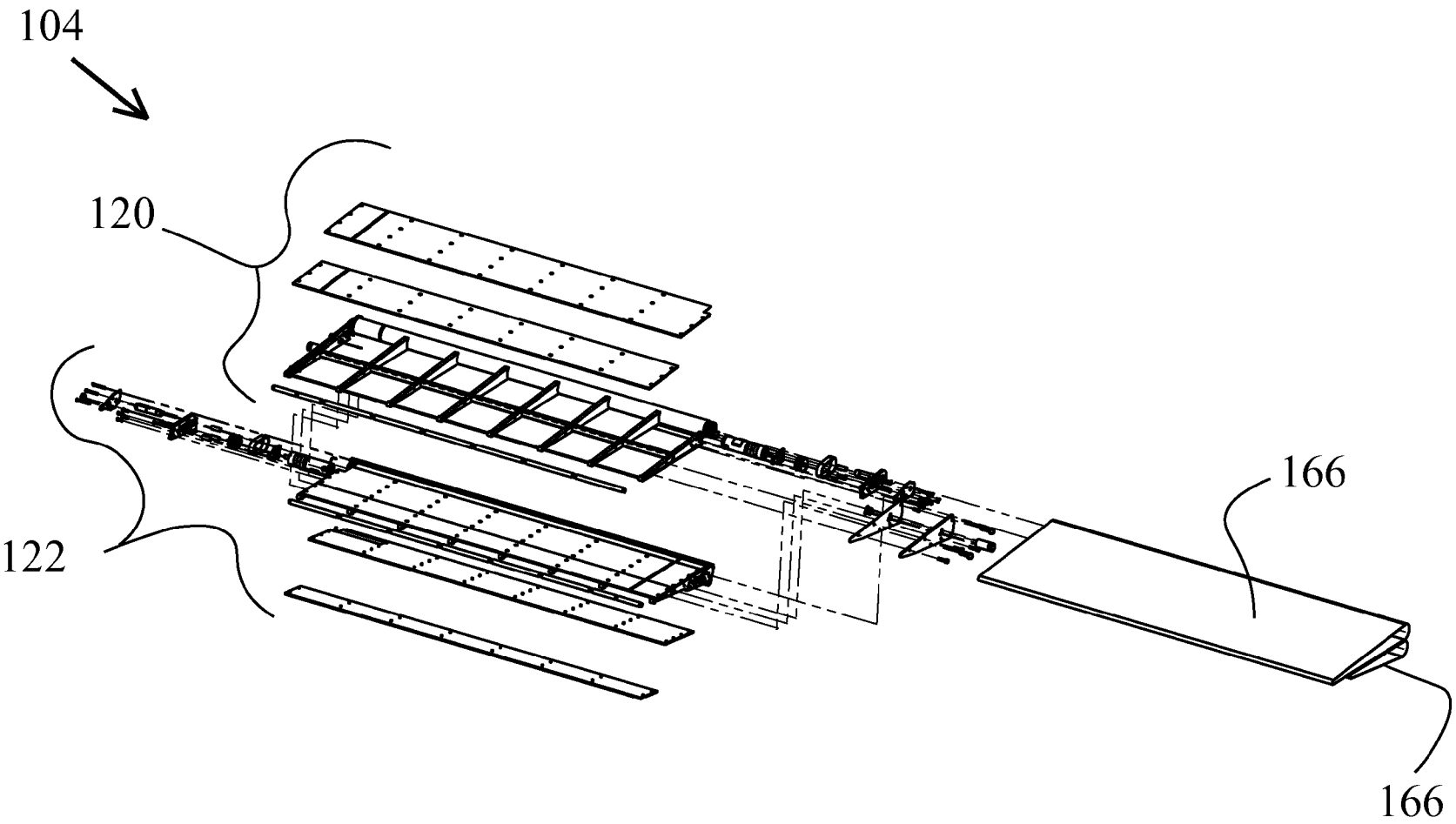
FIG. 22 is an exploded perspective front view of the conveyor unit assembly of the patient transfer device according to one embodiment of the present invention.
Figure 29:
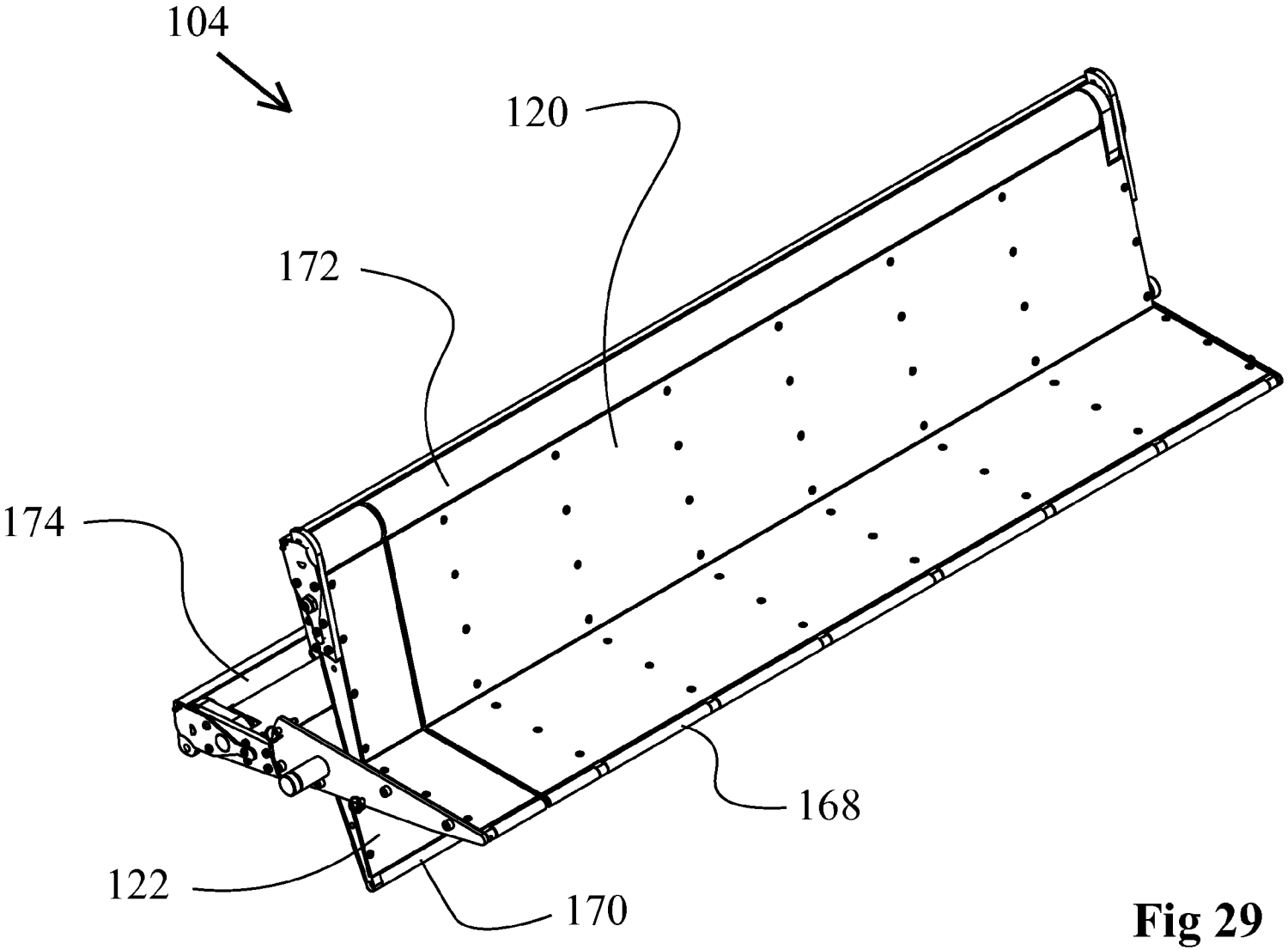
FIG. 29 is a perspective front view of the conveyor unit assembly of the patient transfer device sans the upper and lower conveyor belts and with the conveyors in a cleaning configuration according to one embodiment of the present invention.
Figure 30:
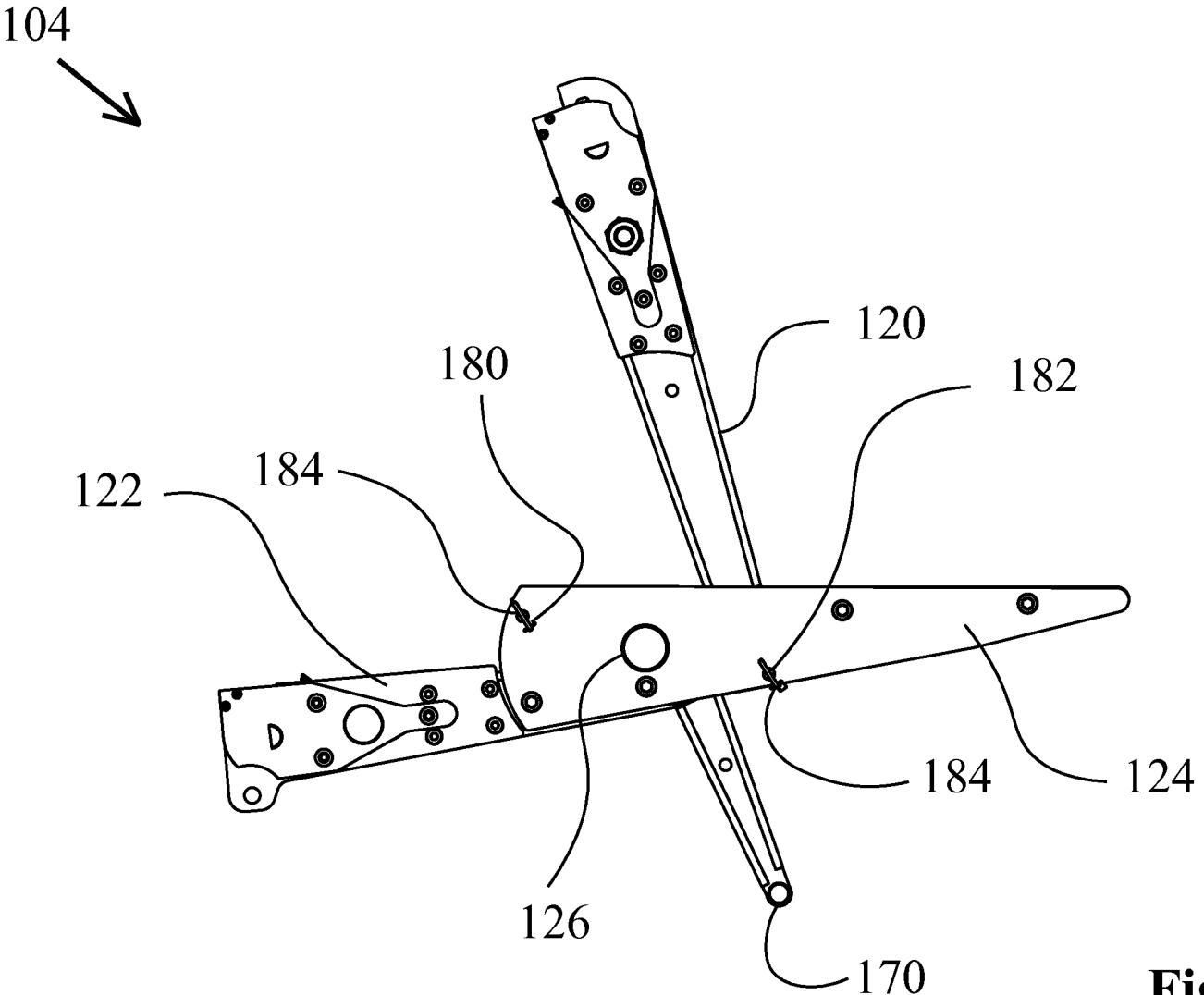
FIG. 30 is a side view of the conveyor unit assembly of the patient transfer device sans the upper and lower conveyor belts and with the conveyors in a cleaning configuration according to one embodiment of the present invention.

The hinged truss frames 154 & 156 of the upper and lower conveyor units 120 & 122 are configured to permit each conveyor unit and collectively the conveyor unit assembly 104 to be placed in a cleaning configuration as shown in FIGS. 29 & 30. Typically on an assembled patient transfer device 100, the conveyor belts 166 would still be installed around the respective conveyor units, but for clarity and presentation the belts are not shown in these views. FIG. 20 shows an end view of the conveyor unit assembly and the side mounting plate 124 in particular. Of note, there is upper push pull pin hole 180 and a lower push pull pin hole 182 that extends through the plate and into the frame truss of the respective upper or lower conveyor unit. As the name suggests these holes receive push pull pins 184 as shown. The pins lock the pivotal portion of the respective conveyor truss frame in its operation orientation. When removed portions of the truss frames can be pivoted. Specifically, the rear portion of the upper conveyor unit is pivoted upwardly and the front portion of the lower conveyor unit is pivoted downwardly. The respective hinges for upper and lower conveyor units as shown in FIGS. 24 & 27 respectively only allows pivotal movement in one direction. When placed in the cleaning configuration, the respective conveyor belts are slack and provide direct access to the back of the belt as well as the surfaces of the guide plates for cleaning and decontamination.

Figure 34:
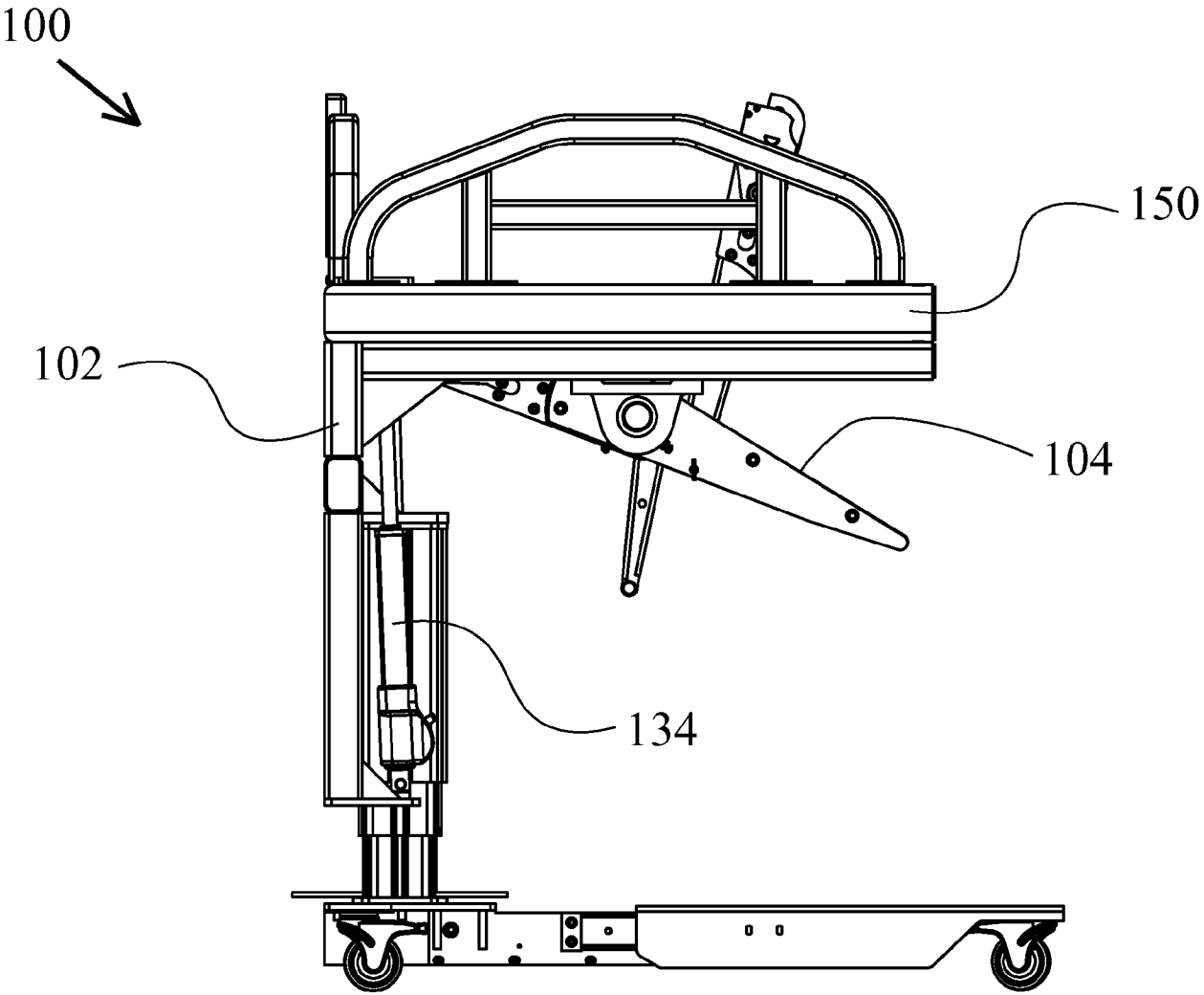
FIG. 34 is a side view of the patient transfer device with the conveyor unit assembly in a cleaning mode orientation according to one embodiment of the present invention.

FIG. 34 shows the conveyor unit assembly in its cleaning configuration while mounted in the frame. The conveyor belts are not illustrated for clarity in displaying the remaining components but would normally be in place around the conveyor units. Of note, when in the cleaning position the tilt actuators 134 are extended to rotate the conveyor unit assembly 104 as far forward as possible to provide for maximum ease of access during a cleaning or wash down operation.

While in the cleaning configuration the tension of the conveyor belts can be adjusted with relative ease. Referring to FIGS. 25, 26 & 28 brackets 186-192 are provided along with associated fasteners that attach the respective large rollers 172 & 174 to the respective truss frames 154 & 156. Fasteners slots and other adjustment means are provided wherein the positioning of the rollers can be adjusted relative to the truss frames thereby loosening or tightening the tension of the belts 166 on each conveyor unit 120 & 122. The adjustment of the roller's positioning can be difficult when the belts are secured there around under tension; however, these adjustments are made easier when the conveyor units have been placed in the cleaning configuration where the belts are loose. The belt tensioning does not have to be reset or adjusted each time the conveyor assembly is placed in its cleaning configuration. Rather, belt tension adjustment is typically required periodically over time as the belts stretch and/or the rollers become misaligned.

Additionally, the pivotal frame trusses 154 & 156 also facilitate in the periodic removal and replacement of the belts 166 when the conveyor unit assembly is removed from the frame unit 112 and the upper and lower conveyor units 120 & 122 are separated as the conveyor belts can slide easily off and on the respective unit when the respective portions of each unit are put into the tilted orientation.

Referencing the side view of the conveyor unit assembly 104 as shown in FIG. 20, the top surface of the upper conveyor unit is canted at a shallow acute angle (typically 5-15 degrees) relative to the horizontally orientated bottom surface of the lower conveyor unit. Overall, this orientation is the orientation of the conveyor unit assembly when the patient transfer device is being used to load or unload a patient. The angle and associated configuration of the conveyor unit assembly allow the front edge to be lower in height and therefore less obtrusive to the patient when he/she is being loaded onto or off of the device. Also, maintaining the lower conveyor unit bottom surface at a horizontal angle spreads out the force necessary to pull the device under the patient over a greater area of the bed or other surface minimizing the risk of deforming or causing the bedding on the bed to bunch. The tilt actuator 134 attached to the frame unit and pivotal connection of the conveyor assembly to the frame unit 112 permits the orientation of the conveyor unit assembly to be changed once the patient is loaded thereon such that the top surface is substantially horizontal. The orientation can then be pivoted back to 5-15 degrees as necessary for unloading.

Operational and Control Systems of the Patient Transfer Device

Figure 31:
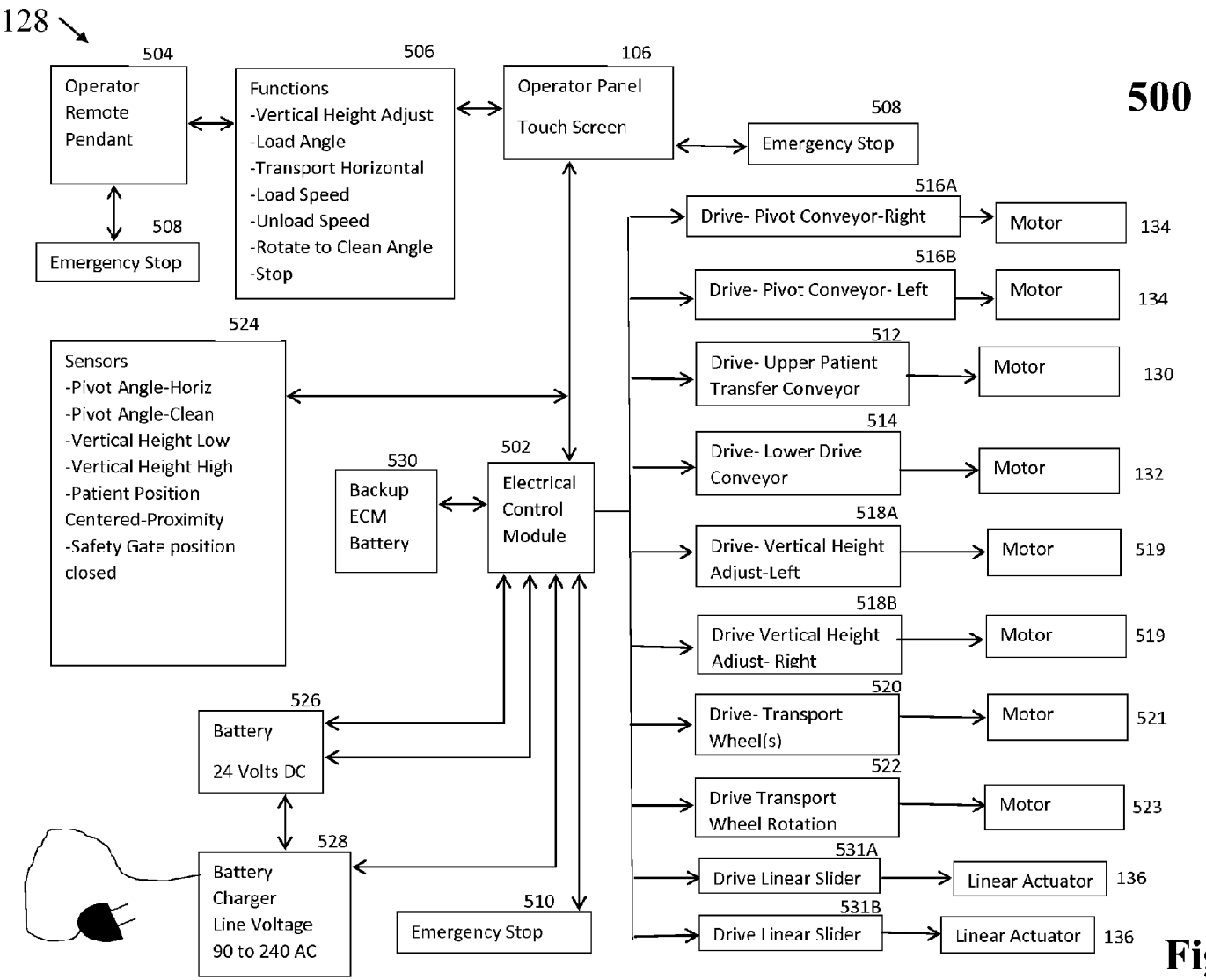
FIG. 31 is a block diagram outlining the electronic systems pertaining to the patient transfer device according to one embodiment of the present invention.

FIG. 31 comprises a block diagram outlining the electrical and control system 128 of the patient transfer device 100. The various components of this system are distributed throughout the frame unit 102 and the conveyor unit assembly and interconnected operationally by wires and electrical traces running there between. Further, wireless communications transceivers can by employed in certain variations in place of a direct electrical connection. For instance, the Operator Remote Pendant 504 may be configured to communicate with the control module 502 or controller by way of Bluetooth or other wireless protocol.

The electric control module 502 or system controller comprising suitable micro circuitry serves to control the operation of all electrical components receiving and processing data and electronic signals from various sensors and components and accordingly adjusting the operating parameters of the device.

Most operations of the patient transfer device are initiated as a result of direction received by the controller 502 from a user interface, such as the an operator touch screen panel 106 or a wired or wireless handheld remote pendant 504. Some of the functions initiated from the user interfaces as detailed in block 506 include: the vertical height adjustment of the frame unit; the changing of the angle of the conveyor unit assembly between the loading and transport configurations; the loading and unloading speeds of the conveyor units; the rotation of the conveyor unit assembly to an angle to facilitate placing the conveyor units into their cleaning configuration; and a stop button. Also, in some variations, the user interface will be configured to control the speed and operation of the optional driven wheel 142. In addition to the normal operational functions each of the user interface devices includes an emergency stop function 508. Additional emergency stop buttons 510 may also be placed in strategic location on and around the device.

Some of the components controlled by the controller include: linear actuator motors 130 & 132 that drive the upper and lower conveyor units as indicated in block 516; one or more linear actuator motors 134 that tilt or pivot the conveyor assembly unit between its various positions as indicated in blocks 516A&B; one or more linear actuator motors 519 in the lifting columns for adjusting the height of the conveyor unit assembly as indicated in blocks 518A&B; and one or more optional motors 521 & 522 for driving the optional drive wheel and turning the drive wheel to control the direction of the patient transfer device as indicated in blocks 520 & 522. The end beam is extended or retracted to change the device's wheel base by way of linear actuators 136 as shown in block 531A&B.

To assist the controller in accomplishing it various functions, various sensors are provided as are indicated in block 524. One or more sensors are used to determine the pivot angle or orientation of the conveyor assembly unit. One or more sensors are utilized to determine the height of the lifting columns. One or more sensors are also provided to assess the position of the patient on the device to ensure he/she is properly centered thereon. These sensors can also be configured to stop the rotation of the upper and lower conveyors once they have detected the patient is fully received on the device. Finally, a sensor can be provided to determine whether the front sensor gate is in place and properly secured. As can be appreciated the controller may prevent the operator from carrying out certain operations depending on readings from the various sensors. For instance, if the patient is not properly centered on the device or the safety gate is not closed, the controller may not allow the activation of the drive wheel (if the device is so equipped).

Typically, the electrical and control system is powered by a deep cycle battery 526. In some variations that device will only work using battery power and will not function if the residual charge in the battery is below a certain minimum level. Other variations permit AC operation or battery operation. Yet other variations allow only certain functions to operate while using AC power. Typically, the device is configured to prevent the transfer of a patient using AC power or while the device is plugged into a wall outlet. Regardless of the specific variation, a battery charger 528 is typically provided as part of the device and can be housed along with the battery within a provided container that is usually located on the frame unit wheeled base 110 or within one of the hollow lifting columns 108. A small backup battery 530 may also be provided that can continue to power the controller 502 and the user interface even if the primary battery becomes fully discharged. In other variations, a larger backup battery is provided that has sufficient charge to accomplish a small number (1-3) transfers in emergency circumstances as a failsafe if the primary battery becomes fully discharged or otherwise fails.

A Method for Loading a Patient from a First Surface on to the Device

Figure 32:
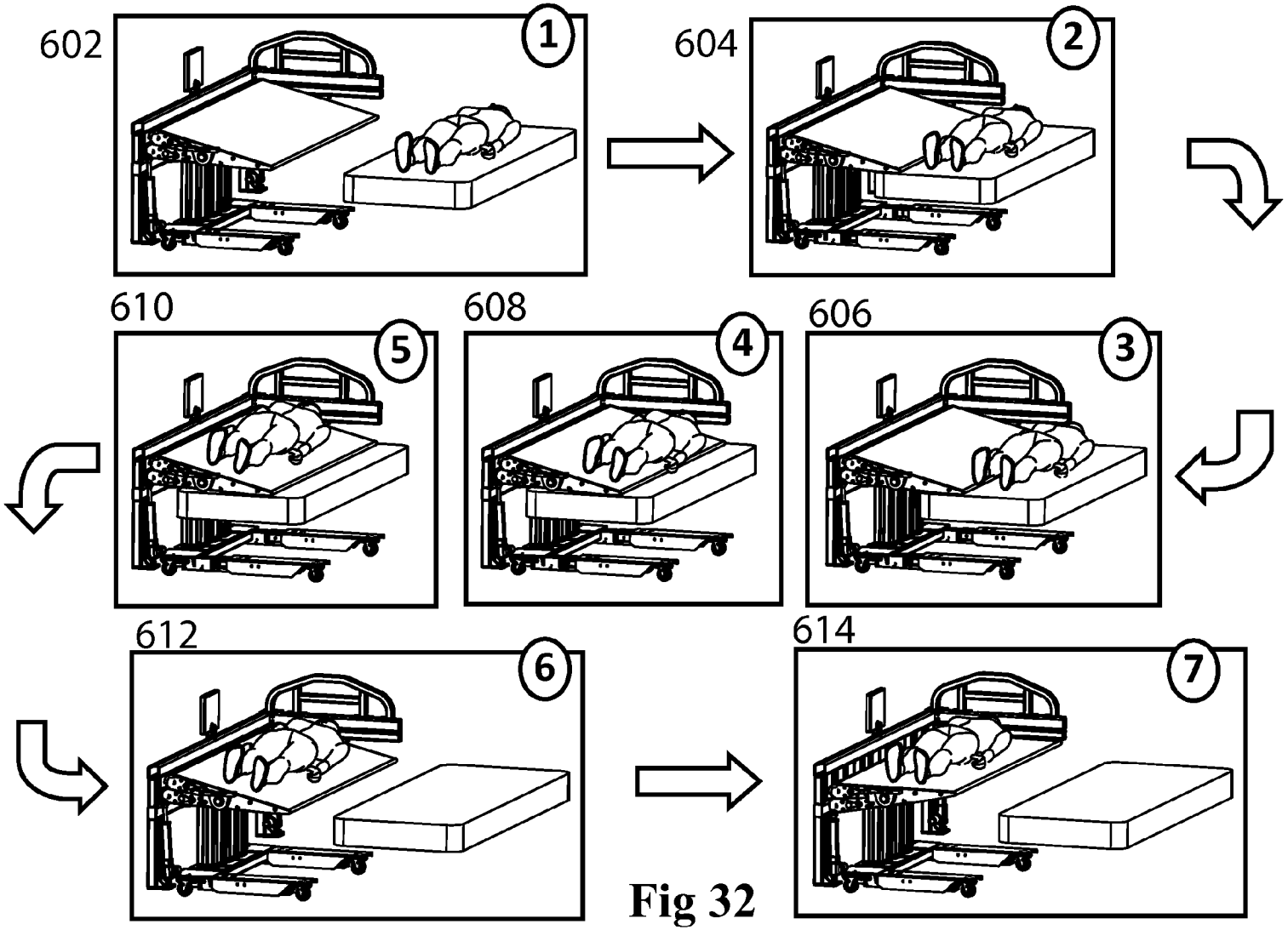
FIG. 32 is a first pictorial flow chart illustrating the process of transferring a patient to the patient transfer device according to one embodiment of the present invention.
Figure 33:
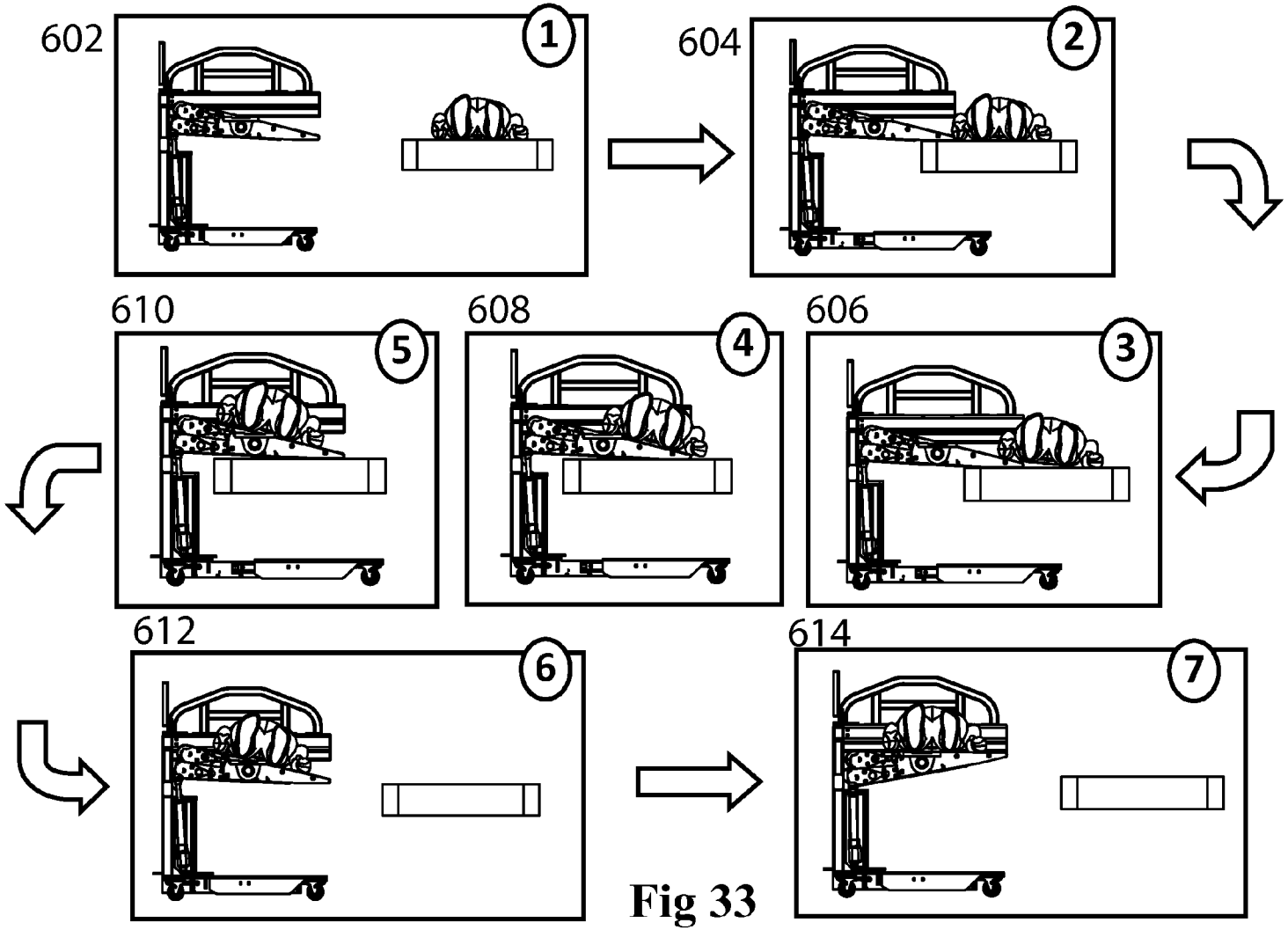
FIG. 33 is a first pictorial flow chart illustrating the process of transferring a patient to the patient transfer device according to one embodiment of the present invention.

FIGS. 32 & 33 comprise flow charts depicting pictorially the steps of loading of a patient onto the patient transfer device. Of note, both Figs depict the same steps albeit from differing perspectives. Further, the illustrations show device with the foremost safety railing 118 and the associated upper leg 150 removed for sake of clarity in illustrating the positioning of the patient: the actual device would not be functional or operate properly with upper leg removed as the conveyor unit assembly 104 would be unsupported on this side.

As shown in block 602, the device is aligned with the hospital bed or other surface on which a patient is lying. The conveyor unit assembly 104 is placed in its loading configuration with the top surface of the upper conveyor angled, and the height of the device is adjusted so the bottom surface of the conveyor unit assembly is essentially the same as the height of the top surface of the bed.

Referring to block 604, the device is positioned next to the bed with the bottom surface of the conveyor unit assembly 104 resting on the top surface of the bed and the front edge of the upper conveyor 120 located close to the side of the patient. As necessary the operator can fine tune the height of the device relative to the bed using the touch screen 106 or pendant user interface. Further, each end beam 114 of the base is extended outwardly by way of the associated linear actuator motors.

As shown in blocks 606-610, the upper and lower conveyor units 120 & 122 are activated so that the belts 166 advance at the same speed as each other but in opposite directions. As shown in the pictures, the upper conveyor belt moves in a clockwise direction and the lower conveyor belt moves in a counterclockwise direction. As the patient is pulled up onto the conveyor, the end beams of the wheeled base 114 are pulled under the bed.

With reference to block 612, once the patient has been fully received onto the conveyor, the operator can pull the device away from the bed and retract the end beams of the wheeled base 110. Finally, as shown in block 614, before wheeling the patient to his/her destination, the operator moves the conveyor unit assembly into the transport configuration wherein the top surface of the upper conveyor 120 is put into a substantially horizontal orientation.

Unloading the patient from the patient transfer device entails performing similar steps and operations but in reverse.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A patient transfer device comprising:

a frame unit having a frame longitudinal length and a frame lateral width, the frame unit including (i) a wheeled base including a plurality of castors, (ii) one or more height extendible vertical supports rising proximate a rear longitudinal edge of the wheeled base, (iii) an upper frame extending laterally outwardly and forwardly from a top of the one or more vertical supports;

a conveyor unit assembly having a conveyor longitudinal length and a conveyor lateral width, each corresponding to the frame longitudinal length and width respectively, the conveyor including (i) an upper conveyor unit having a first width, a first front roller assembly and a first rear roller assembly with the first rear roller assembly having a larger width than the first front roller assembly, and a first endless belt extending therebetween, (ii) a lower conveyor unit having a second width, a second front roller assembly and a second rear roller assembly with the second rear roller assembly having a larger width than the second front roller assembly and a second endless belt extending therebetween, the second width being less than the first width, and (iii) left and a right conveyor mounting brackets located at the respective left and right ends end of both the upper and lower conveyor units and joining both conveyor units together in a spaced relationship with the upper conveyor unit located above the lower conveyor unit, the conveyor unit assembly being pivotally mounted to the upper frame by way of the conveyor mounting brackets; and an electrical/control system, the system including a first electric motor operatively coupled to the first rear roller, a second electric motor operatively coupled to the second rear roller, one or more tilt actuators for pivoting the conveyor unit assembly relative to the frame unit, a controller unit, a user interface and a power supply;

wherein (a) the upper conveyor unit includes a hinged upper framework with an upper hinge extending across the framework longitudinally at a location between the first rear roller and the first front roller, and (b) the lower conveyor unit includes a hinged lower framework with a lower hinge extending across the framework longitudinally at a location between the second rear roller and the second front roller.

2. The patient transfer device of claim 1, wherein the wheeled base further includes:

at least one extendable end beam, the end beam including one or more casters of the plurality of casters mounted thereon and configured to move between a retracted first position and an extended second position, the end beam increasing the width of the wheeled base at least 3" forward of the first position in the second position; and one or more electric end beam actuators configured to move the one or more end beams between the first and second position.

3. The patient transfer device of claim 2, wherein the end beam increases the width of the wheeled base at least 6".

4. A method of using the patient transfer device of claim 2, the method comprising:

positioning the patient transfer device next to a hospital bed with a patient laying thereon;

placing the conveyor unit assembly in a loading orientation wherein a top surface of the upper conveyor unit is canted forwardly at an angle of 5-15 percent off of horizontal and a bottom surface of the lower conveyor unit is substantially horizontally orientated;

raising or lowering the conveyor unit assembly to align a front longitudinal edge with a longitudinal edge of the bed by lengthening or shortening the one or more height extendible vertical supports;

rolling on the plurality of castors the front longitudinal edge of the conveyor unit assembly over a top surface of the bed and next to the patient;

activating the conveyor unit assembly by turning on the first and second electric motors wherein the first and second endless belts rotate in opposite directions but at the same linear speed;

moving the patient on to the conveyor assembly while the patient transfer device crawls over the surface of the hospital bed;

once patient is fully received on the conveyor unit assembly, placing the conveyor unit assembly in a transport orientation with the top surface of the upper conveyor unit on which the patient is lying is substantially horizontal; and rolling the patient transfer device away from the hospital bed.

5. The patient transfer device of claim 2, wherein the controller is configured to lock out operation of the conveyor unit assembly and the first and second electric motor unless the at least one extensible end beam has been extended.

6. The patient transfer device of claim 1, wherein each of the one or more height extendible vertical supports comprise a set of two or more nestable tubular structures with the smaller structures fitting in the larger structures when in a fully lowered configuration and extending upwardly from the larger structures as the height of the device is raised.

7. The patient transfer device of claim 6, wherein at least one of the one or more height extendible supports includes a linear actuator, the linear actuator being substantially contained within the tubular structures.

8. The patient transfer device of claim 6, wherein one or more height extendible vertical supports comprises three more height extendible vertical supports.

9. The patient transfer device of claim 6, wherein one or both the power supply and the controller unit are substantially housed the tubular structures.

10. The patient transfer device of claim 1, wherein the upper frame further includes one or more removable safety rails.

11. The patient transfer device of claim 1, wherein one or more of the caster comprises a driven caster, the caster being mounted to the wheeled base and being associated with at least a first caster motor, the first caster motor being configured to turn a wheel of the driven caster.

12. The patient transfer device of claim 11, wherein the driven caster further includes a second caster motor, the second caster motor being configured to affect the orientation of the caster.

13. The patient transfer device of claim 1 wherein: (1) the frame unit includes left and right upper legs with facing parallel left and right bearing mounts being secured to respective upper arms; (2) the left and right conveyor mounting brackets each include pivot spindle, the respective spindle being pivotally received in the corresponding bearing mount.

14. The patient transfer device of claim 1, wherein each of the one or more tilt actuators are mounted on one end to the frame unit and on the other end to the conveyor unit assembly proximate a rear longitudinal edge.

15. The patient transfer device of claim 1, wherein a top surface of the upper conveyor unit forms a shallow acute angle with a bottom surface of the lower conveyor unit.

16. The patient transfer device of claim 15, wherein the shallow acute angle is 5-15 degrees.

17. The patient transfer device of claim 15, wherein the shallow acute angle is about 10 degrees.

18. The patient transfer device of claim 1, wherein the conveyor assembly unit is movable between at least a first and second orientation relative to the frame unit using the one or more tilt actuators, the first orientation placing a top surface of the upper conveyor unit at an acute angle of 5-15 degrees relative to horizontal with a front longitudinal edge being lower than a rear longitudinal edge, and the second orientation placing the top surface substantially parallel relative to horizontal.

19. The patient transfer device of claim 1, wherein the power supply comprises one or more batteries.

20. The patient transfer device of claim 1, wherein a rear portion of the upper conveyor unit located to a rear of the upper hinge is upwardly pivotal adapted to place the rear portion in a position forming an angle of about 60-100 degrees relative to a front portion of the upper conveyor unit located to the front of the upper hinge.

21. The patient transfer device of claim 20, wherein a front portion of the lower conveyor unit located to a front of the lower hinge is downwardly pivotal adapted to place the front portion in a position forming an angle of about 60-100 degrees relative to a rear portion of the lower conveyor unit located to the rear of the lower hinge.

22. The patient transfer device of claim 21, wherein a plurality of selectively removable push pull pins with each selectively removable push pull pin passing through one of the left and right conveyor mounting brackets and into the respective hinged framework of the upper and lower conveyor unit assemblies, the plurality of selectively removable push pull pins retaining the front and rear portions of the respective upper and lower conveyor assemblies linearly aligned.

23. A method of cleaning the patient transfer device of claim 22, the method comprising:

pivoting the conveyor assembly unit forward in the frame unit by way of the one or more tilt actuators;

removing the plurality of selectively removable push pull pins;

pivoting the rear portion of the upper conveyor unit upwardly to form a 60-100 degree angle with the front portion of the upper conveyor unit;

pivoting the front portion of the lower conveyor unit downwardly to form a 60-100 degree angle with the rear portion of the lower conveyor unit; and with the endless belts slack, cleaning or washing down the conveyor unit assembly.

24. The patient transfer device of claim 1, where when in operation the first and second endless belts are configured to be driven by the respective first and second electrical motor and rotate in opposite directions but at substantially the same linear speed.

25. A method of using the patient transfer device of claim 1, the method comprising:

positioning the patient transfer device next to a hospital bed with a patient laying thereon;

placing the conveyor unit assembly in a loading orientation wherein a top surface of the upper conveyor unit is canted forwardly at an angle of 5-15 percent off of horizontal and a bottom surface of the lower conveyor unit is substantially horizontally orientated;

raising or lowering the conveyor unit assembly to align a front longitudinal edge with a longitudinal edge of the bed by lengthening or shortening the one or more height extendible vertical supports;

rolling on the plurality of castors the front longitudinal edge of the conveyor unit assembly over a top surface of the bed and next to the patient;

activating the conveyor unit assembly by turning on the first and second electric motors wherein the first and second endless belts rotate in opposite directions but at the same linear speed;

moving the patient on to the conveyor assembly while the patient transfer device crawls over the surface of the hospital bed;

once patient is fully received on the conveyor unit assembly, placing the conveyor unit assembly in a transport orientation with the top surface of the upper conveyor unit on which the patient is lying is substantially horizontal; and rolling the patient transfer device away from the hospital bed.

26. The patient transfer device of claim 1, wherein the at least one extendable end beam comprises a left end beam and a right end beam, each end beam including a single castor of the one or more castors mounted proximate a front end thereon, and wherein the one or more electric actuators comprises (a) a left linear actuator mounted to the left end beam and (b) the right linear actuator mounted to the right end beam.

27. The patient transfer device of claim 1, wherein (1) a first tilt actuator beam extends downwardly proximate a left rear longitudinal edge of the upper frame and a second tilt actuator beam extends downwardly proximate a right rear edge of the upper frame, (2) the one or more tilt actuators comprise a left tilt actuator and a right tilt actuator, (3) the left tilt actuator is mounted at a bottom end to a location proximate a bottom end of the first tilt actuator beam and the right tilt actuator at a bottom end is mounted to a location proximate a bottom end of the second tilt actuator beam, and (4) the left tilt actuator is mounted at a top end to a location proximate left end of the rear longitudinal edge of the conveyor unit assembly and the right tilt actuator is mounted to a location proximate a right end of the rear longitudinal edge of the conveyor unit assembly.

28. The patient transfer device of claim 27, wherein first and second tilt actuators comprise electric linear actuators.

29. The patient transfer device of claim 1, wherein the user interface comprises a touch screen, the touch screen being mounted to the upper frame.

30. The patient transfer device of claim 1, wherein the first and second electric motors are only configured to operate when a level of charge of the battery exceeds a predetermined minimum level.

* * * * *